US009133651B2

(12) United States Patent
Trinh et al.

(10) Patent No.: US 9,133,651 B2
(45) Date of Patent: Sep. 15, 2015

(54) FURNITURE DRAWER LOCKING DEVICE

(71) Applicants: Albert Long Trinh, Maineville, OH (US); Dennis Sam Trinh, Maineville, OH (US); Toan Trinh, Maineville, OH (US)

(72) Inventors: Albert Long Trinh, Maineville, OH (US); Dennis Sam Trinh, Maineville, OH (US); Toan Trinh, Maineville, OH (US)

( * ) Notice: Subject to any disclaimer, the term of this patent is extended or adjusted under 35 U.S.C. 154(b) by 0 days.

(21) Appl. No.: 13/835,535

(22) Filed: Mar. 15, 2013

(65) Prior Publication Data

US 2014/0091694 A1 Apr. 3, 2014

Related U.S. Application Data

(60) Provisional application No. 61/706,913, filed on Sep. 28, 2012.

(51) Int. Cl.

| | |
|---|---|
| ***E05B 65/44*** | (2006.01) |
| ***E05B 65/46*** | (2006.01) |
| ***E05C 19/18*** | (2006.01) |
| *E05B 67/38* | (2006.01) |
| *E05C 19/06* | (2006.01) |
| *E05B 15/00* | (2006.01) |
| *E05B 15/16* | (2006.01) |

(52) U.S. Cl.

CPC ..... *E05B 65/44* (2013.01); *E05B 65/46* (2013.01); *E05C 19/182* (2013.01); *E05B 15/0046* (2013.01); *E05B 15/1607* (2013.01); *E05B 67/383* (2013.01); *E05C 19/066* (2013.01); *Y10T 29/49947* (2015.01); *Y10T 70/5097* (2015.04)

(58) Field of Classification Search

CPC ..... E05B 65/44; E05B 65/46; E05B 65/461; E05B 65/462; E05B 65/467; E05B 2065/469; E05B 15/0046; E05B 15/1607; E05B 67/383; Y10T 70/5128; Y10T 70/5097; Y10T 29/49947; G07G 1/0027; E05C 19/182

USPC ..... 70/14, 77–88, DIG. 9; 292/256, 258, 292/259 R, 260, 288–298; 312/215, 216, 312/333

See application file for complete search history.

(56) References Cited

U.S. PATENT DOCUMENTS

| | | | | | |
|---|---|---|---|---|---|
| 321,628 | A | * | 7/1885 | Nelson | 292/256 |
| 413,128 | A | * | 10/1889 | Brabson | 70/14 |
| 1,464,415 | A | | 12/1891 | Bate | |
| 2,787,847 | A | | 4/1905 | Kollme | |
| 827,624 | A | * | 7/1906 | Foster | 292/288 |
| 1,321,514 | A | * | 11/1919 | Erickson | 70/86 |
| 1,330,936 | A | | 2/1920 | Erickson | |
| 1,490,811 | A | | 4/1924 | Falsani | |
| 1,496,099 | A | * | 6/1924 | O'Connor | 70/86 |
| 1,772,252 | A | * | 8/1930 | Henry | 70/440 |

(Continued)

FOREIGN PATENT DOCUMENTS

| | | |
|---|---|---|
| GB | 148717 | 8/1920 |

*Primary Examiner* — Lloyd Gall

(74) *Attorney, Agent, or Firm* — Hasse & Nesbitt LLC; Daniel F. Nesbitt

(57) ABSTRACT

A device for securing closed a drawer of a dresser, cabinet or desk. The device includes a base that is secured to an interior surface of the frame, which cannot be accessed when the drawer is closed within the drawer opening of the frame, and an extending member. The extending member has a first end portion that attaches releasably to the base, and a second end that extends exteriorly through the drawer opening and between the drawer and the frame. The device is not built into or integral with the drawer or the frame of the dresser, cabinet or desk.

19 Claims, 39 Drawing Sheets

(56) References Cited

U.S. PATENT DOCUMENTS

| | | | | | |
|---|---|---|---|---|---|
| 1,864,883 | A | | 6/1932 | Anderson | |
| 2,140,066 | A | * | 12/1938 | White | 70/14 |
| 2,903,286 | A | * | 9/1959 | Joseph et al. | 292/295 |
| 2,918,318 | A | * | 12/1959 | Sacharski | 292/87 |
| 3,013,426 | A | | 12/1961 | Taylor | |
| 3,262,292 | A | | 7/1966 | Glass | |
| 3,381,992 | A | | 5/1968 | Friesen | |
| 3,397,001 | A | | 8/1968 | Friedman | |
| 3,423,968 | A | | 1/1969 | Foote | |
| 3,475,929 | A | * | 11/1969 | Weingart | 70/14 |
| 3,497,059 | A | * | 2/1970 | Watts, Jr | 206/463 |
| 3,649,095 | A | | 3/1972 | Gunzburg | |
| 3,834,746 | A | * | 9/1974 | Hinden | 292/290 |
| 3,847,462 | A | | 11/1974 | Repetti | |
| 3,850,463 | A | | 11/1974 | Hawkins | |
| 3,854,764 | A | * | 12/1974 | Corrigan | 292/289 |
| 3,856,373 | A | | 12/1974 | Tucich | |
| 3,933,402 | A | | 1/1976 | Peterson | |
| 4,030,426 | A | | 6/1977 | Lyons | |
| 4,030,788 | A | | 6/1977 | Bleeker | |
| 4,142,391 | A | * | 3/1979 | Paig | 70/461 |
| 4,326,394 | A | * | 4/1982 | Stein | 70/14 |
| 4,505,526 | A | | 3/1985 | Leck | |
| 4,525,012 | A | | 6/1985 | Dunner | |
| 4,617,810 | A | * | 10/1986 | Fish et al. | 70/14 |
| 4,715,628 | A | | 12/1987 | Brink et al. | |
| 4,819,463 | A | * | 4/1989 | Jacobs | 70/14 |
| 4,873,850 | A | | 10/1989 | Lyons et al. | |
| 5,033,803 | A | * | 7/1991 | Katsuyoshi et al. | 312/138.1 |
| 5,136,862 | A | * | 8/1992 | Langen | 70/14 |
| 5,154,497 | A | | 10/1992 | Smith | |
| 5,243,736 | A | | 9/1993 | Cannaday et al. | |
| 5,292,191 | A | | 3/1994 | Slivon | |
| 5,325,685 | A | * | 7/1994 | Frank | 70/14 |
| 5,493,880 | A | * | 2/1996 | Jang | 70/202 |
| 5,704,665 | A | * | 1/1998 | Budolfson | 292/295 |
| 5,743,608 | A | | 4/1998 | Johannes | |
| 5,784,907 | A | * | 7/1998 | Hu et al. | 70/203 |
| 5,819,561 | A | * | 10/1998 | Blehi, III | 70/14 |
| 5,944,396 | A | | 8/1999 | Stephan | |
| 6,179,399 | B1 | | 1/2001 | Brustle et al. | |
| 6,406,781 | B1 | | 6/2002 | Hamerski | |
| 6,416,089 | B1 | * | 7/2002 | Williams, Jr. | 292/288 |
| 6,481,811 | B1 | * | 11/2002 | Marsh | 312/333 |
| 6,527,900 | B1 | | 3/2003 | Kreckel et al. | |
| 6,541,089 | B1 | | 4/2003 | Hamerski et al. | |
| 6,547,289 | B1 | | 4/2003 | Greenheck et al. | |
| 6,655,762 | B2 | | 12/2003 | Krueger | |
| 7,567,744 | B2 | | 7/2009 | Krampotich et al. | |
| 8,220,297 | B2 | * | 7/2012 | Palumbo et al. | 70/57 |
| 8,496,276 | B2 | * | 7/2013 | Kaminsky, Jr. | 292/216 |
| 8,544,899 | B2 | * | 10/2013 | Hertrich | 292/195 |
| 2003/0213094 | A1 | | 11/2003 | Wills | |
| 2006/0261716 | A1 | | 11/2006 | Chen et al. | |
| 2007/0085352 | A1 | * | 4/2007 | Ulanday et al. | 292/288 |
| 2007/0096478 | A1 | * | 5/2007 | White | 292/288 |
| 2008/0053167 | A1 | | 3/2008 | Basche | |
| 2009/0217713 | A1 | | 9/2009 | Loughlin et al. | |
| 2010/0301996 | A1 | | 12/2010 | Stradiota | |

* cited by examiner

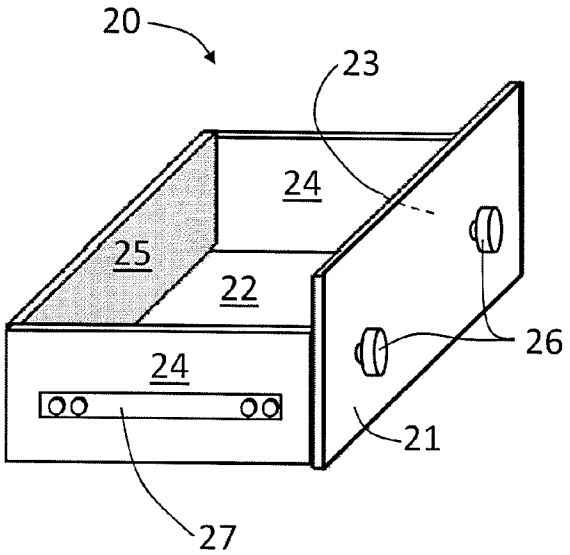
FIG. 2 - Prior Art
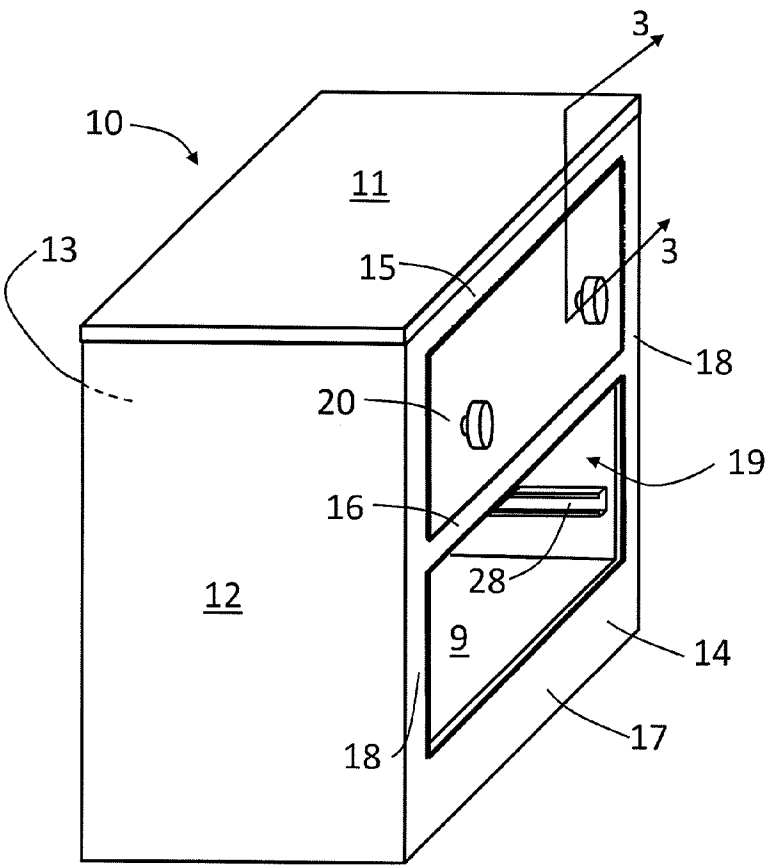
FIG. 1 - Prior Art

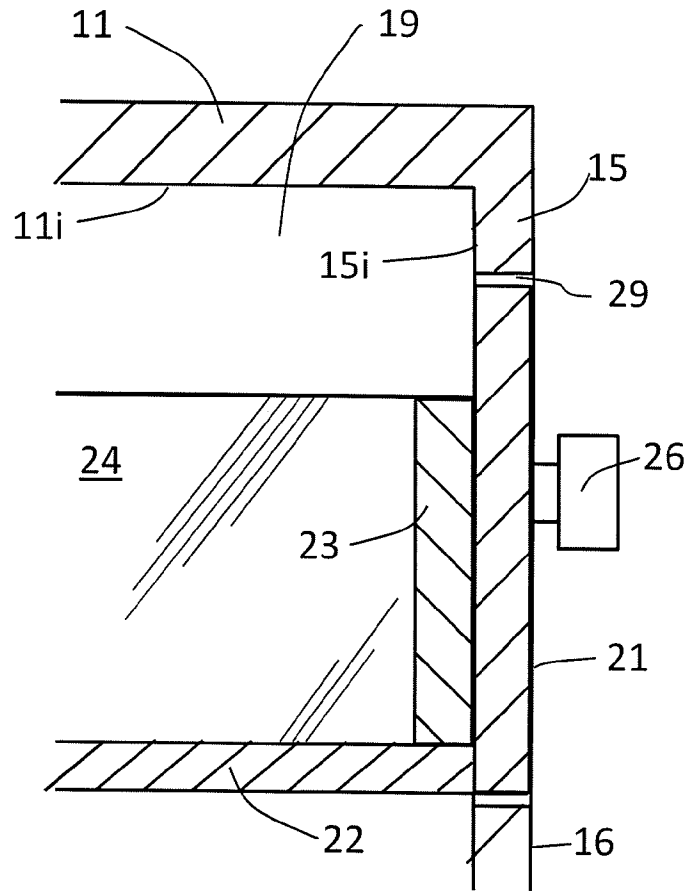
FIG. 4 - Prior Art
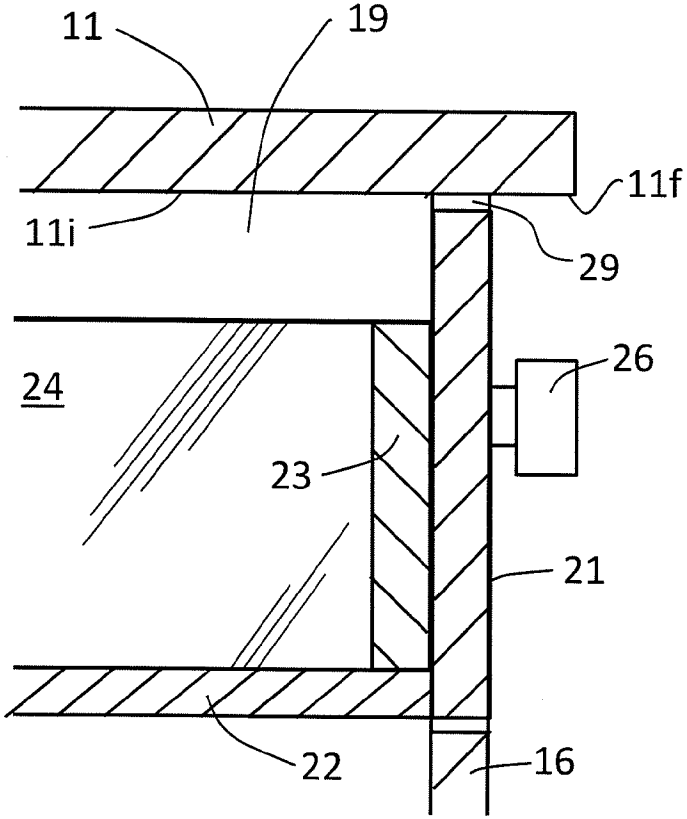
FIG. 3 - Prior Art

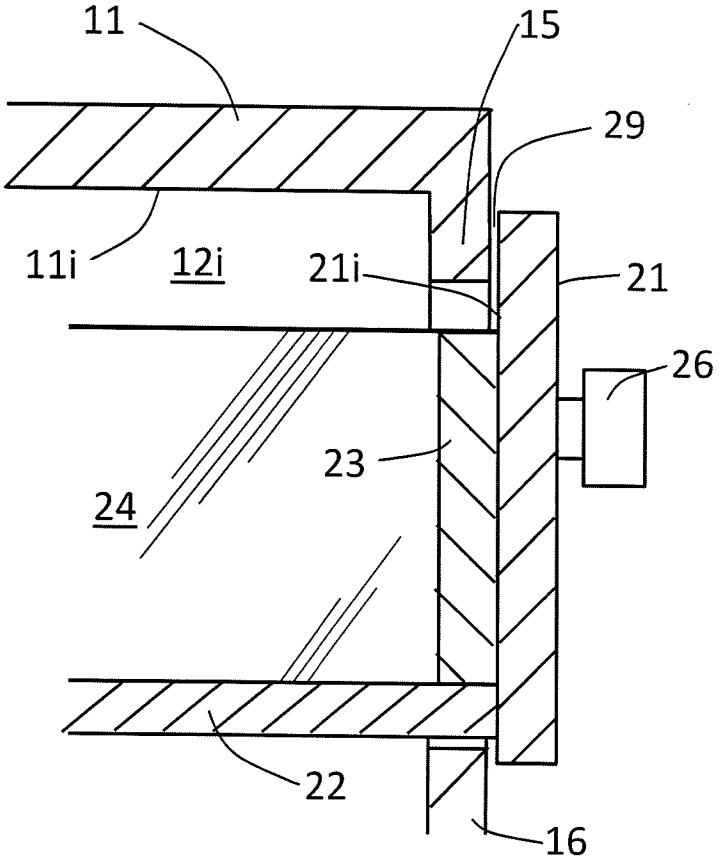
FIG. 6 - Prior Art
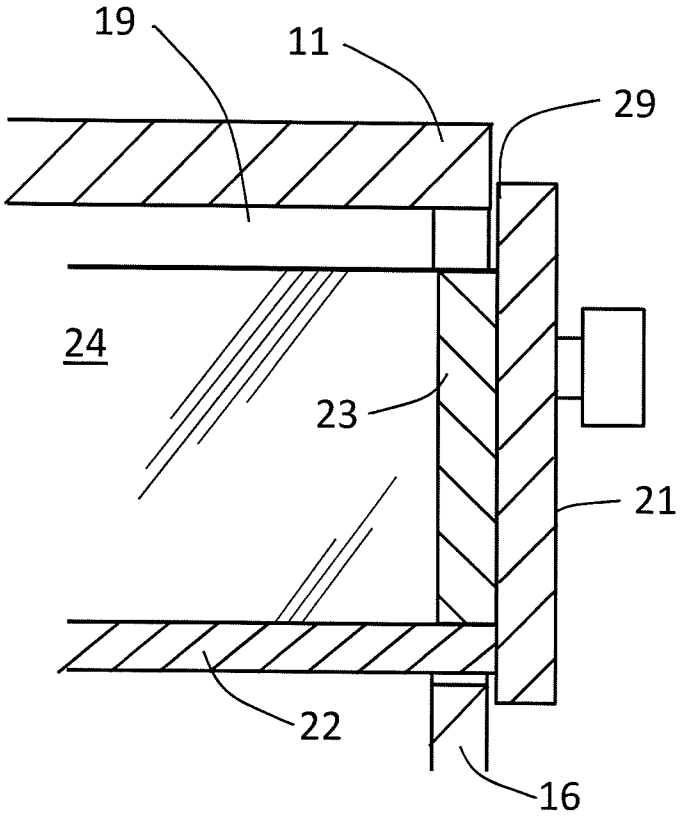
FIG. 5 - Prior Art

FURNITURE DRAWER LOCKING DEVICE

CROSS REFERENCE TO RELATED APPLICATIONS

This application claims the benefit of U.S. Provisional Application No. 61/706,913, filed on Sep. 28, 2012, the disclosure of which is incorporated herein by reference.

FIELD OF THE INVENTION

The present invention relates generally to a locking device for drawers of furniture.

BACKGROUND OF THE INVENTION

Persons when traveling or staying outside their home place their personal belonging into whatever furniture happens to be available. For travelers, the accommodations may be a hotel, motel, a bed-and-breakfast, or the home or apartment of a friend or relative. Persons staying outside the home can include students residing in a dormitory or apartment, and person visiting relatives or friends. In the case of a hotel, motel and a bed-and-breakfast, the person can typically lock the room so that outsiders cannot gain access to the room, although cleaning, maintenance and security personnel may have keys to access the room. In the case of apartment rooms, dormitory rooms or within the homes or apartment of relatives or friends, the living area may be locked but may be shared with one or more other persons, or the living area may be unlocked, allowing free access thereto.

In many hotels, a guest may have a security box or vault within the room or the hotel itself, within which the guest can securely lock away valuables such as jewelry and electronic devices, cash, etc. For guests or traveler in hotels, apartments, dormitory rooms or the homes of friends and relatives, the guest, student or traveler may provide their own lockable luggage, security box, or baggage, within which cash, valuable or personal or business documents and articles can be secured, away from access to others.

Other times, the guest, traveler, or student simply wants to secure their personal items and valuables in a furniture drawer, away from the persons having legitimate access to the area, such as roommates, family members, etc., who may snoop around or may be curious about another person's belongings. The temporary lock for a furniture drawer in such a case needs not be unbreakable or unassailable, but should reveal signs of tampering or entry if unauthorized access is attempted. The temporary lock is used as a means to deter and discourage the unauthorized access to a curious snooper.

One location in which a person might store valuables, sensitive or confidential documents, etc. is in a drawer of furniture provided in the accommodations, such as a dresser, cabinet or desk. While office furniture is typically provided with built-in locks that prevent a drawer from being opened, most dresser drawers, and drawers in many cabinets and desks, are not made with integral locks. Thus, there is a need for a temporary lock to deter and discourage the unauthorized access to a curious snooper by requiring a definitely strong effort to open a drawer protected by such lock, and once opened the drawer cannot be returned to the locked condition by the intruder.

SUMMARY OF THE INVENTION

The present invention provides a locking device for securing closed a drawer of a furniture, including: a) a securable base for securement to an interior surface of a frame of the furniture, the securable base being inaccessible when secured when the drawer is closed within a drawer opening of the frame, and b) an extending member having an attaching end portion that attaches releasably to the securable base, and a locking end portion that is configured to extend exteriorly through the drawer opening and between the drawer and the frame, the locking end portion including a locking means for preventing the drawer, when closed, from opening within the drawer opening.

The present invention also provides a method for securing closed a drawer within a drawer opening of a furniture, comprising the steps of: a) attaching an attaching end portion of an extending member to an interior surface of a frame of the furniture, b) extending a locking end portion of the extending member through a gap between the drawer and the frame, and c) attaching a locking means to the locking end portion to prevent the drawer, when closed, from opening within the drawer opening.

The locking device of the invention is designed and configured for temporary attachment to the furniture, and more particularly, for temporary attachment to an interior surface of the furniture that cannot be seen from outside the furniture, and cannot be accessed (reached or touched by hand) from outside the furniture, with the drawer in the closed position within the drawer opening of the furniture.

The invention also relates to instruction associated with the use of the locking device with furniture, directing the consumer to attach the locking device to the furniture having a drawer, and for closing and locking the drawer in the furniture. The invention also relates to a method of locking and securing a drawer of the furniture using the locking device.

The invention also relates to an article of manufacture comprising the locking device, packaged in association with instructions for use by a consumer, with the use of the locking device with furniture, and with a method of locking and securing a drawer of the furniture using the locking device.

BRIEF DESCRIPTION OF THE DRAWINGS

The invention will be more clearly understood from the following detailed description of representative embodiments thereof in conjunction with the accompanying drawing figures wherein;

FIG. 1 shows a perspective view of conventional dresser with drawer openings and a drawer;

FIG. 2 shows a perspective view of a conventional dresser drawer;

FIG. 3 shows a sectional view through the front with a top drawer of a first type of dresser and drawer, through line-3-3 of FIG. 1;

FIG. 4 shows a sectional view through the front of the top drawer of a second type of dresser and drawer, through line-3-3 of FIG. 1;

FIG. 5 shows a sectional through the front of the top drawer of a third type of dresser and drawer, through line-3-3 of FIG. 1;

FIG. 6 shows a sectional view through the front of the top drawer of a fourth type of dresser and drawer, through line-3-3 of FIG. 1;

DETAILED DESCRIPTION OF THE INVENTION

Figure 7:
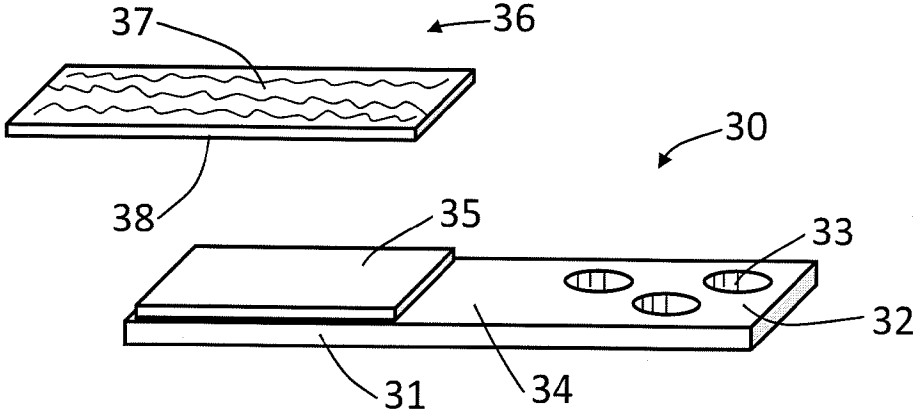
FIG. 7 shows a first embodiment of a drawer locking device, including a base member and an extending member.

The phrase "opening of a drawer" means the outward movement of a drawer, from within a drawer opening defined by the frame of a furniture, that is uninhibited by a securing or locking device, and is more than a wiggling of the drawer, and is more than a "cracking open" the drawer by a centimeter, or by a couple of centimeters.

The phrase "securing closed a drawer" means to install a drawer locking device onto a drawer, closing the drawer, and locking the drawer locking device against drawer to prevent the drawer from opening by an ordinary pulling force sufficient to open an unlocked drawer. The invented device itself may use a lock for securing closed the drawer. The device is not a lock that is integral with or build into or inside the drawer face. Notwithstanding the locking device may be useful with a drawer that has lock that is integral with or built into or insider the drawer face, but has a broken, lost or missing key.

A conventional dresser and drawer are shown in FIGS. 1 and 2. Conventional dressers and drawers come in a variety of styles and sizes. FIG. 1 shows the general construction of a dresser 10, having an enclosed frame having drawer openings and including a top 11, sides 12, a back 13, a front 14, and a bottom-drawer floor 9. The front 14 has openings 19 for receiving drawers 20, the openings defined by vertical portions 18 called stiles, and by horizontal rails, including a top rail 15, an intermediate or cross rail 16, and a bottom rail 17.

The drawer 20 is an open-topped box, and includes a bottom 22, a front wall 23 (shown, for example, in FIG. 3), side walls 24, a rear wall 25, and a front (false) face 21 attached to the front wall 23. The front face 21 is commonly taller than the front wall 23. In some drawers, the front face can serve as the front wall of the open-topped box. Handles 26 are attached to the front face 21 for manually pulling the drawer 20 open when the drawer is disposed within opening 19 of the dresser in a closed position. The drawer 20 moves laterally within the opening on a track 27 fastened to the drawer side 24 that moves along a guide 28 mounted on the inside the opening of the dresser. The track and guide system maintains the drawer in horizontal orientation when disposed within the dresser opening.

Four styles of dresser openings and drawers are shown in cross-section in FIGS. 3-6, to illustrate aspects of the invention, but in no way to limit the scope of the invention. The dresser drawers and openings considered in FIGS. 3-6 relate mainly to the top-level drawers and top-level openings. By top-level, it means the drawer and the opening that are closest to the top side of the furniture. However, in many cases, the lock devices of the present invention are applicable also to lower-level drawers.

FIG. 3 shows a first style of dresser and drawer with the drawer disposed within the drawer opening in the closed position, in which the planar interior surface 11*i* of the dresser top 11 is substantially coincident with a gap 29 defined horizontally between an upper edge of the front face 21 of the drawer, and the front, interior surface 11*i* of the top 11. In this style, the outer surface of the front face 21 of the drawer can be substantially flush with the front 14 of the dresser. The periphery of the front face 21 of the drawer 20 is disposed within the opening 19 of the dresser. The front edge 11*f* of the dresser top 11 can extend forward horizontally over the upper edge of the front face 21 of the drawer 20, as shown in FIG. 3, although in another embodiment of the first style of dresser and drawer, the front edge of the dresser top can be flush with or only slightly extended forward of the front face of the drawer.

FIG. 4 shows a second style of dresser and drawer with the drawer disposed within the drawer opening in the closed position, in which the top rail 15 extends downward from the top 11 of the dresser, such that planar interior surface 11*i* of the dresser top 11 is not substantially coincident with the gap 29, which is defined horizontally between an upper edge of the front face 21 of the drawer, and a lower edge of the top rail 15. In this style as well, the outer surface of the front face 21 of the drawer is substantially flush with the front 14 of the dresser, and specifically flush with the top rail 15, and the periphery of the front face 21 of the drawer 20 is disposed within the opening 19.

The horizontal gap 29 for dressers and desks of the first style (depicted in FIG. 3) and the second style (depicted in FIG. 4) is usually about 1.8 millimeters or wider, such as about 3.0 millimeters and wider, for dressers and desks of average quality and that are commonly found in college dormitories. The horizontal gap 29 for high quality furniture can be narrower, about 1.2 millimeters and can be even narrower.

FIGS. 5 and 6 show a third style and a fourth style of dresser opening and drawer in the closed position, in which the periphery of the front face 21 of the drawer 20 is larger than the opening 19. In the third style shown in FIG. 5, the top edge of the front face 21 extends over the forward or front edge of the dresser top 11. In the fourth style shown in FIG. 6, the top rail 15 extends downward from the top 11 of the dresser, and the top edge portion of the front face 21 extends upward and over the outside surface of the top rail 15. Typically the side and bottom edges of the front face 21 can also extend over the outside surfaces of the stiles 18 and the cross rail 16. In the third style of dresser, the gap 29 is defined vertically between the front edge of the top 11 and the upper, inner surface of the front face 21. In the fourth style of dresser, the gap 29 is defined vertically between the forward surface of the top rail 15 and the upper, inner surface of the front face 21.

A first embodiment of a drawer locking device of the present invention is shown in FIG. 7, which illustrates an elongated extending member 30 having an attaching end portion 31 that releasably attaches to a base member 36 on the inside of a dresser piece of furniture having a drawer, and a locking end portion 32 that extends exteriorly from within the dresser through the drawer gap 29. This embodiment can be used as a drawer locking device for the first style of dresser and drawer shown in FIG. 3, with the locking end portion 32 extending between the drawer 20 and top 11 of the dresser frame.

The attaching end portion can comprise a first rectangular planar portion, and the locking end portion can comprise a second rectangular planar portion. The second rectangular planar portion of the locking end portion can extend in the same plane as the first rectangular planar portion of the attaching end portion. A major dimension of the second rectangular planar portion can be oriented transverse to a major dimension of the first rectangular planar portion. The second rectangular planar portion can extend from the middle of an edge of the first rectangular planar portion. The first rectangular planar portion and the second rectangular planar portion can comprise a unitary plate.

The elongated extending member 30 shown in FIG. 7 is illustrated as having a narrow width in comparison to its length (about a 6:1 ratio of length to width). It can be understood that the ratio of length to width can be even greater (more elongated) or lesser. Since the locking end portion of the device extends through the horizontal gap 29 between the dresser and the drawer in the closed position, a broader width at the locking end portion 32 can prevent the extending locking end portion 32 from being pivoted within the gap around its axis, if an attempt is made to loosen and free the attachment of the device to the base member by jiggling or shaking.

The elongated extending member is illustrated as a rectangular and substantially planar member. The extending member is made of a resilient material and of a thickness suitable to provide resilience so that it is not easily bent from its planar form, and may be resistant to cutting, breaking or degrading, such as by melting, or has shape memory wherein if the member is bent by force, it returns to substantially its original shape after the force is removed. Non-limiting examples of a material for the extending member include aluminum, hardened steel, tempered steel, chrome-plated steel, stainless steel, other metals and alloys, thermoplastic materials, including polycarbonate, acrylic, nylon, polyethylene, polypropylene, etc., and laminates and components thereof.

The thickness of the extending member, or at least the thickness of the locking end portion, is at least about 1 mm, or at least about 1.5 mm, or at least about 2.0 mm, or at least about 2.5 mm, and up to about 5 mm, or up to about 4 mm, or up to about 3 mm, or up to about 2 mm; for example, about 3.0 mm, about 2.2 mm, about 1.7 mm, about 1.5 mm, about 1.2 mm, and about 1.0 mm.

The exposed planar surfaces of the extending member that is not covered by the attachment member, and in particular the locking end portion, can be coated with a plastic material to reduce chipping or scratching of the wooden surfaces of the dresser and drawer.

The upper (or inner) surface 34 of the attaching end portion 31 includes a first attachment member 35. In the illustrated embodiment, the first attachment member 35 is a mechanical fastener material, covering substantially the entire top surface of the attaching end portion 31.

Figure 8:
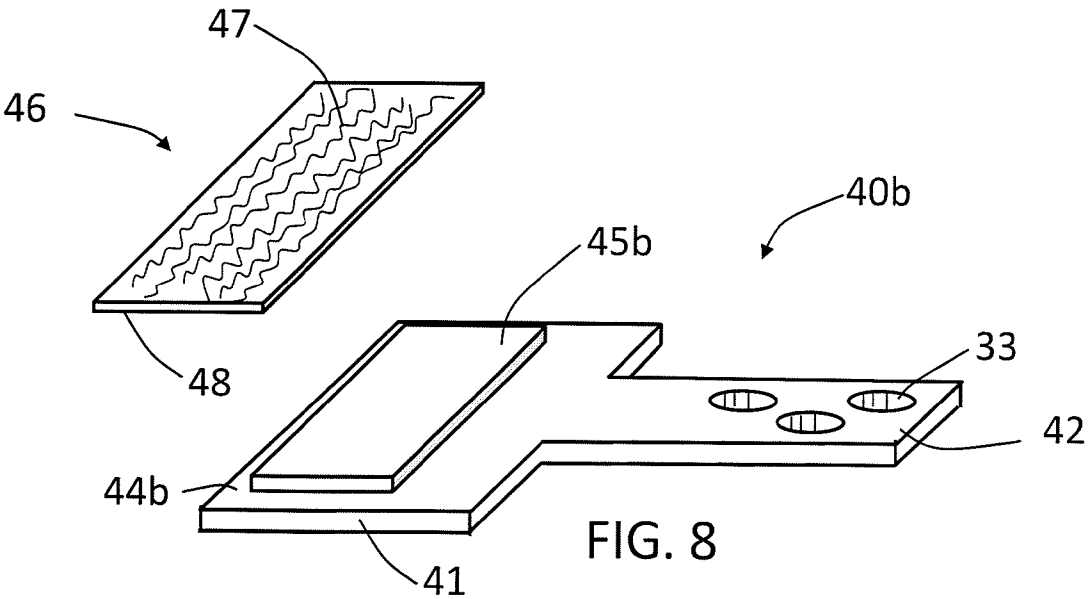
FIG. 8 shows an alternative to the first embodiment of the drawer locking device.
Figure 9:
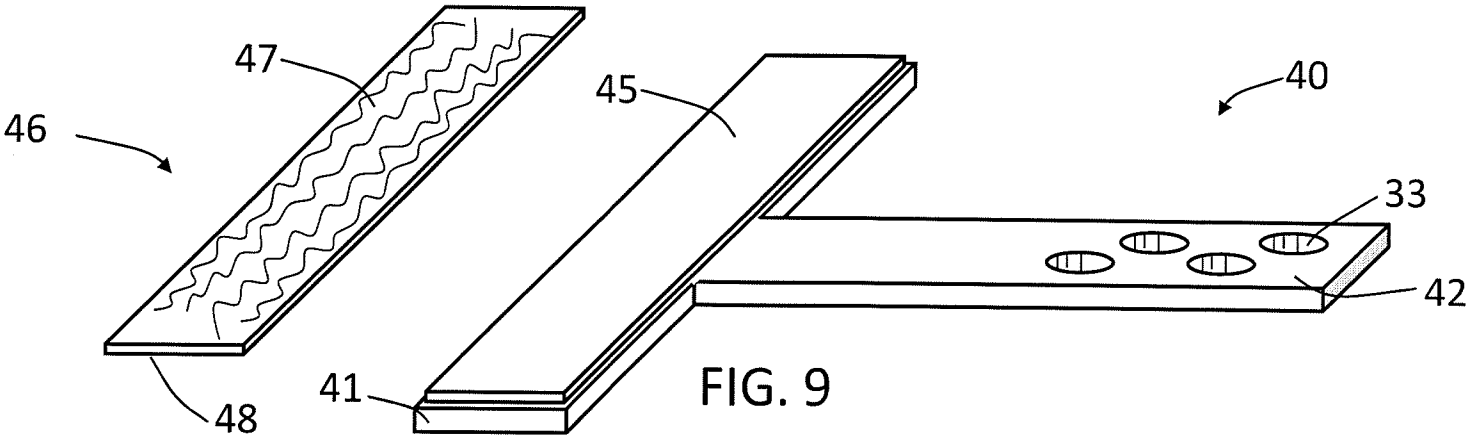
FIG. 9 shows another alternative to the first embodiment of the drawer locking device.

Alternative embodiments 40,40*b* of the elongated extending member is shown in FIGS. 8 and 9, having a "T" shape. The cross-member part of the "T" shape is the attaching end portion 41, while the upright part of the "T" shape includes the locking end portion 42. The base member 46 is consequently oriented to register with the cross-member 41. In the device shown in FIG. 8, the wider attaching end portion 41 extends toward the locking end 42 more so than the device in FIG. 9, to extend through the gap 29 when installed.

The base member 36,46 can be a planar substrate having an upper surface 37,47 having a securement means for securing the base 36,46 to a portion of the inside surface 11*i* of the dresser top 11. In one aspect of the embodiment, the securement means is an adhesive material, typically a layer of adhesive material, for example pressure-sensitive adhesive, that covers the upper surface 37,47 of the base member, and which secures adhesively the base 36,46 to the inside surface 11*i* of the dresser top 11. The adhesive is applied to any part of the upper surface 37,47 in any effective pattern, including a uniform coating.

The base member 36,46 also comprises a lower surface having a second attachment member 38,48. In the illustrated embodiment, the second attachment member is a mechanical fastener material, covering substantially the entire lower surface of the base member 36,46. The second attachment member 38,48 of the base member 36,46 releasably attaches to the first attachment member 35,45 of the attaching end portion 31,41 of the extending member 30,40. The base member itself can be a base layer of the mechanical fastener to which the mechanical fastener material is attached. The base member is typically not built into or made integral with the drawer or the frame of the furniture, although such furniture construction is within the operation and scope of the invention.

In the illustrated embodiment, the first and second mechanical fastener materials are attached together to form a mechanical fastener of the extending member 30 to the base 36. One mechanical fastener is a hook-and-loop type nylon fastener, commonly known as Velcro™. The first mechanical fastener material applied for the attaching end portion 31 of the extending member 30 can be either the hook nylon material or the loop nylon material, while the second mechanical fastener material for the base 36 is the corresponding loop nylon material or hook nylon material, respectively.

Figure 10:
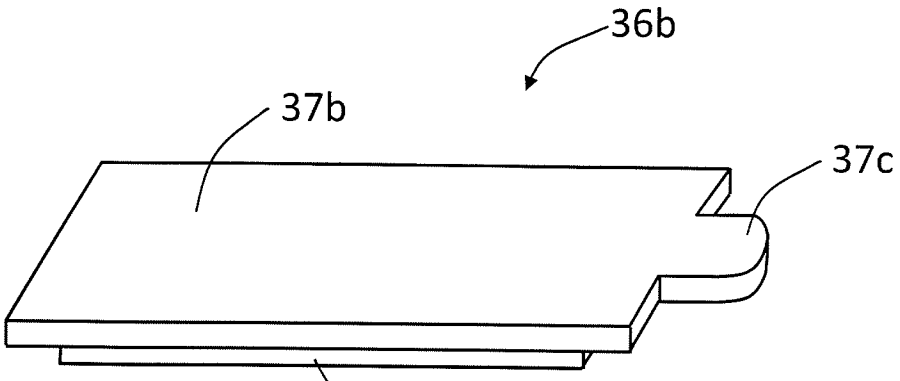
FIG. 10 shows an alternative embodiment of a base member of the drawer locking device.

An alternative embodiment of the base member 36*b* is shown in FIG. 10, which comprises a stretch-releasable adhesive strip 37*b* for removably affixing the base member 36*b* to the dresser. The stretch-releasable adhesive strip 37*b* is arranged between the second attachment member 39 and the dresser surface, for securing the base member to the dresser surface. To remove or releasing the attached base member 36*b*, a pull tab 37*c* on the end of the adhesive strip is grasped and pulled, which stretches and releases the adhesive strip from the dresser surface. Non-limiting examples of stretch-releasable adhesive element are described in U.S. Pat. Nos. 6,541,089, 5,516,581, 5,747,133, 6,001,471, 6,106,630, and 6,406,781, the disclosures of which are incorporated by reference in their entireties.

Both the base member 36 and the attaching end portion 31 of the extending member 30 are elongated, and/or widened, in order to increase the surface area of the associated securement means and attachment means. The elongated base member 36 increases the surface area of adhesive attachment of the base 36 to the inside surface 11*i* of the dresser top 11. The elongated attaching end portion 31, and the elongated lower surface 38 of the base 36, increase the surface area of the mechanical fastener formed therebetween.

A drawer locking device of the present invention includes a locking means configured in or along the locking end portion 32. FIGS. 7-9 illustrate a locking means as at least one hole or bore 33, through which a lock device, such as the shackle of a padlock or a combination padlock, can be inserted. Preferably the locking means is a plurality of holes or bores that are arranged in a crisscrossing or zig-zag pattern to provide a tighter fit of the shackle of the padlock to the top edge of the front face 21 of the drawer 20, to provide a tighter and more secure closure of the drawer.

Figure 11:
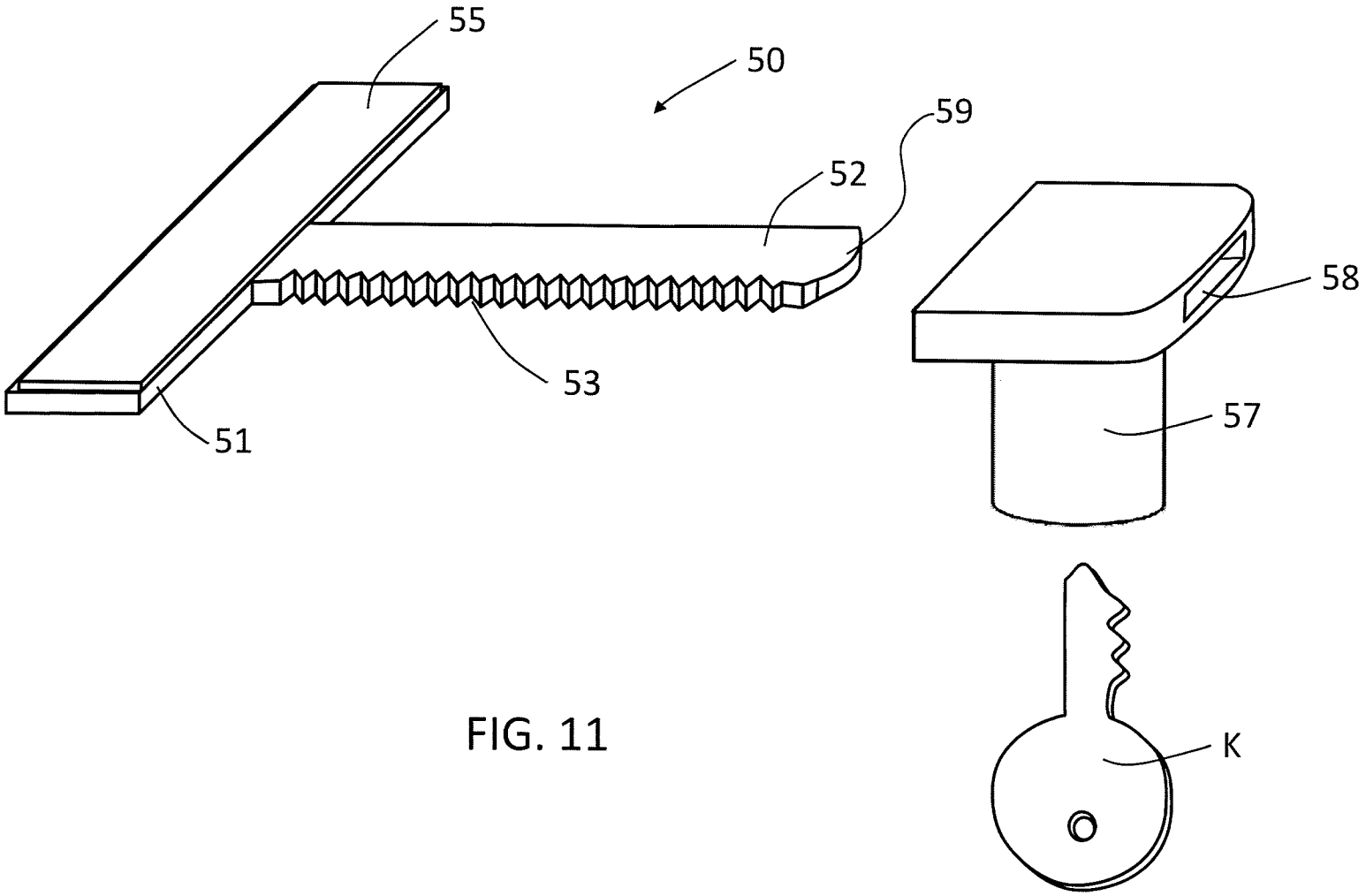
FIG. 11 shows an alternative embodiment of the extending member and a locking means of the locking device.

An alternative drawer locking device is shown in FIG. 11, wherein a locking end portion 52 includes a locking means comprising a plurality of lock engaging elements 53 (teeth or ridges) disposed along an edge, or both edges, of the locking end portion 52, and a lock device, illustrated as a ratcheting lock 57 having a body with a transverse slot 58 which is of a size suitable to slidably receive the locking end portion 52. The locking end portion, when used with a ratcheting lock, is configured with a width and a thickness to pass through the transverse slot 58 of the ratcheting lock 57, and can have a leading edge 59 that is rounded to facilitate insertion into the transverse slot. The ratcheting lock 57 has internal, complementary engaging elements (not shown) for engaging the lock engaging teeth 53, for securing the ratcheting lock 57 to and along the length of the locking end portion 52, and disengaging the same by operation of a key K. The ratcheting lock can allow a tighter and more secure closure of the drawer than that of a padlock, due to a denser arrangement of lock-engaging teeth. A non-limiting example of the locking means and a ratcheting lock is described in U.S. Pat. No. 2,878,663, the disclosures of which are incorporated by reference in its entirety. The base member and the attaching end portion in FIG. 11 is similar to the base member and attaching end portion of FIG. 9, but it is understood that the base member and attaching end portion of other embodiments, such as the base member and attaching end portion in FIGS. 7 and 8 are also suitable.

It should be understood that the above-described locking means comprising a plurality of lock engaging teeth or ridges along an edge of the locking end portion, and a lock device comprising internal, complementary engaging elements, operated by a key, can be employed as the locking means with any of the other embodiments of drawer locking devices described herein; for example, in place of or in addition to the plurality of locking holes and padlock. This locking means is suitable for the all styles of dressers and drawers, and is preferred for the first style of dresser and drawer depicted in FIG. 3, wherein the front edge 11*f* of the dresser top 11 extends forward horizontally over the upper edge of the front face 21 of drawer 20.

Figure 12:
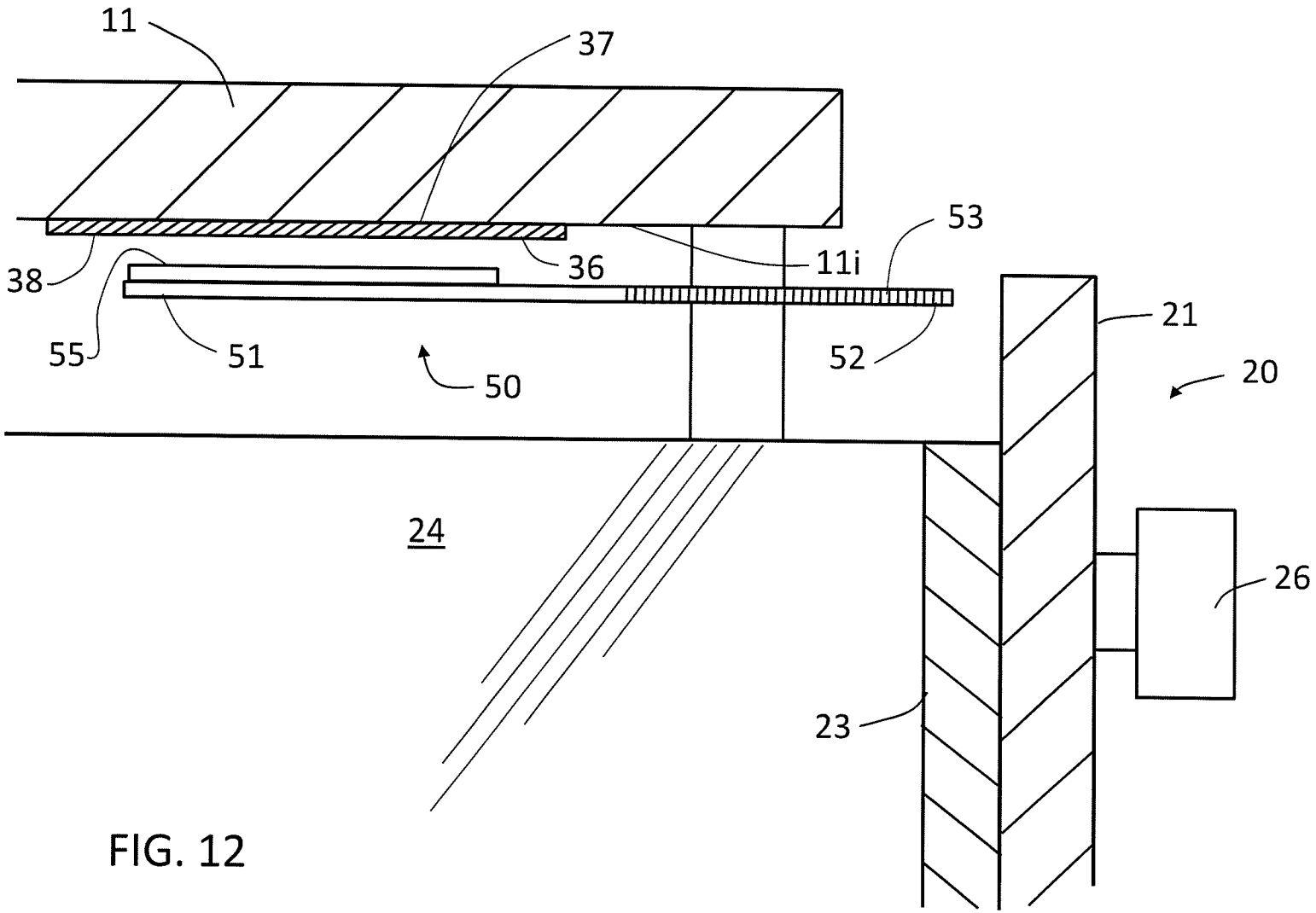
FIG. 12 shows the first embodiment of the locking device being positioned for attachment to the inside of the first type of dresser and drawer.
Figure 13:
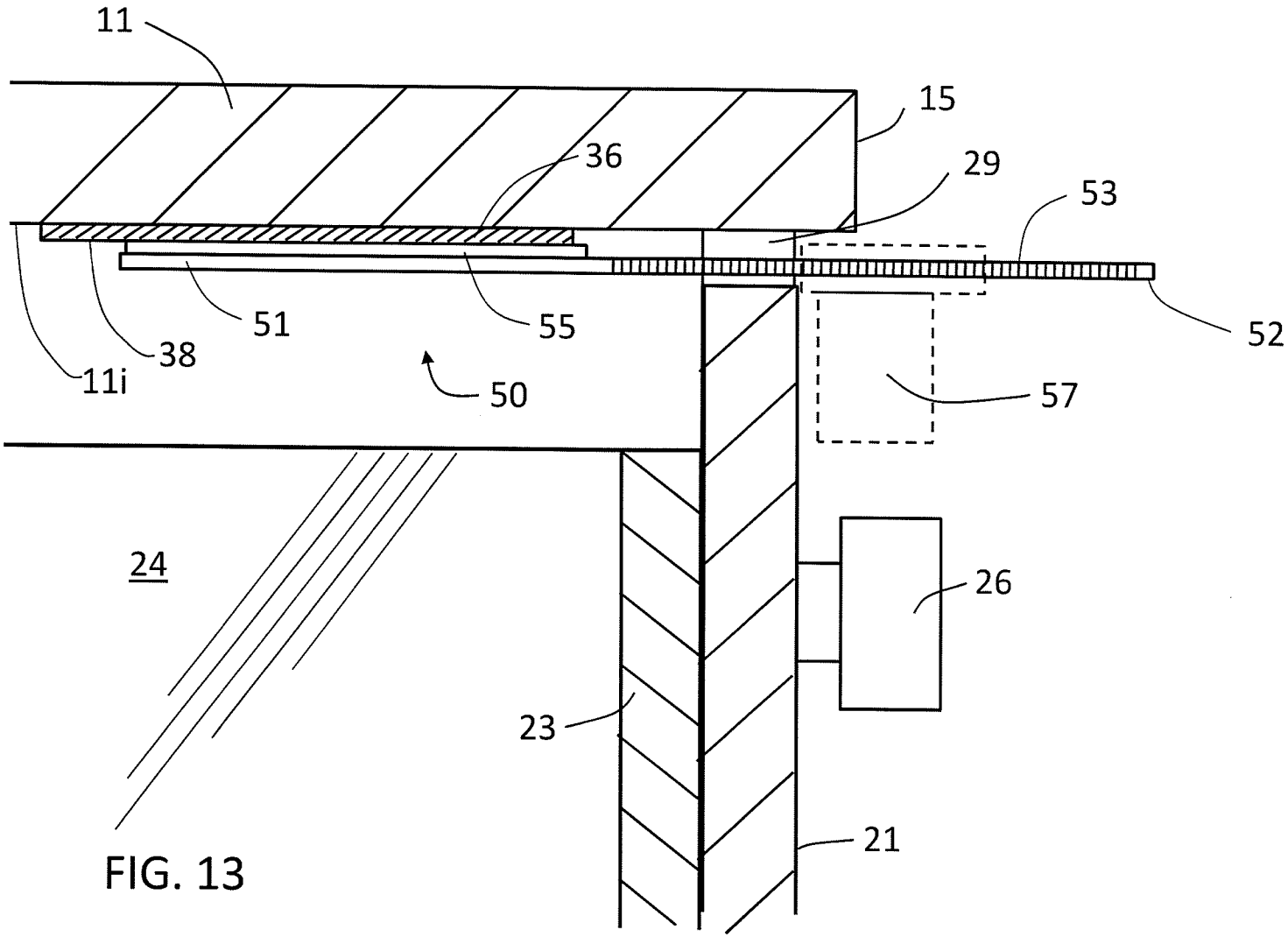
FIG. 13 shows the sectional view of the first embodiment of the locking device attached and locked, using a display case ratchet lock, to the first type of dresser and drawer with the drawer closed.

FIGS. 12 and 13 show the first embodiment of the drawer locking device used for locking a drawer in the first type of dresser and drawer that is shown in FIG. 3. FIG. 12 shows the drawer 20 pulled open, and the base member 36 secured by the user to the inside surface 11*i* of the dresser top 11. The exposed adhesive-layered surface 37 is positioned upward, facing the inner surface 11*i*, with the long dimension of the elongated base member oriented in the direction of opening of the drawer 20 (perpendicular to the front face 21, hereinafter, the "opening direction"), and then pressed upward onto the inner surface 11*i* to secure the base member 36 to the inside surface 11*i* of the top 11. The adhesive-layered surface 37 may be covered with a release paper, which is removed prior to securing the base member 36 to the inside of the dresser. If necessary, the drawer 20 may be removed from the opening 19 to facilitate installing the base member 36. The base member 36 is intended to remain secured to the dresser for so long as the user chooses. Typical of adhesively-applied substrates to a structure, the force to peel the base member 36 from the inside top surface will be substantially less than the shear force of the adhered substrate to the inner surface when a force is applied to the base member 36 in a direction parallel to the planar surface. Under normal use of the drawer, the base member 36 is not visible from outside the dresser.

Figure 14:
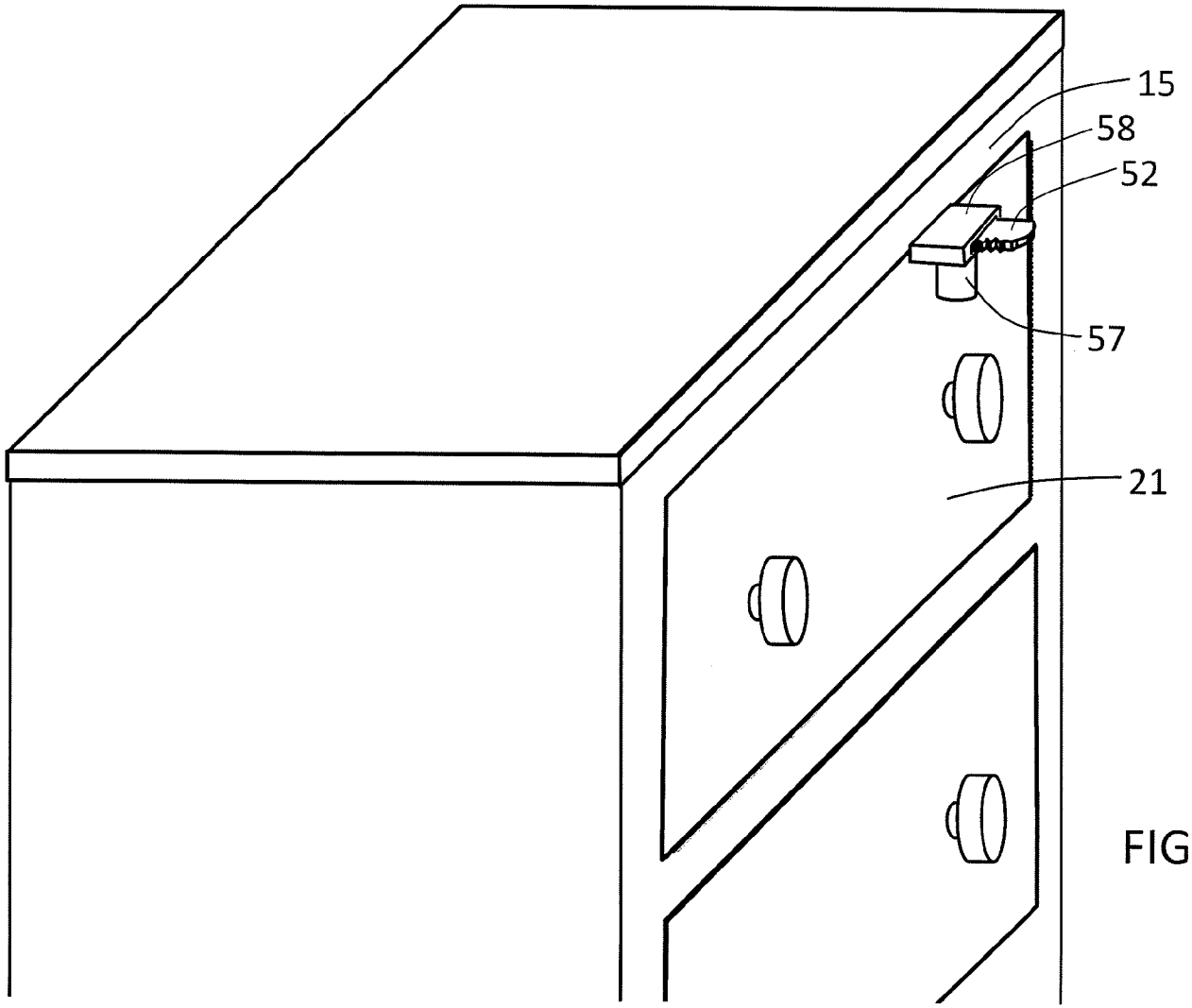
FIG. 14 shows the outside-the-drawer view of the first embodiment of the drawer locking device of FIG. 13 attached and locked to the dresser.

When the user wants to lock the drawer closed, the drawer is opened, and an extending member, illustrated as extending device 50, is attached to the base member 36. The user orients the extending member 50 with the locking end portion 52 facing outward in the direction of drawer opening, and the attachment member 55 disposed upward to face the corresponding mating attachment member 38 of the base member 36. Aligning the extending member 50 is done to maximize the registry of the two attachment members 55 and 38, and to provide that the lock engaging teeth 53 extend beyond the forward surfaces of the top 11 of the dresser and the front face 21 of the drawer. After alignment, the extending member 50 is pressed upward into the base member 36 to form the mechanical fastening. After the drawer 20 is closed, the locking end portion 52 extends through the gap 29 between the drawer face 21 and the top rail 11. The transverse slot 58 of the ratcheting lock 57 is then slipped over and along the teeth 53 of the locking end portion 52, with the body of the ratcheting lock pointing downward, as shown in FIG. 13. The ratcheting lock 57 is positioned next to the face 21 of the drawer, with very little space for pulling open the drawer. An attempt by another person to open the drawer, by force, will be noticeable and an indication to the user that another person had tried to open, or did open, the drawer. FIG. 14 shows the dresser after closing the drawer and locking the extending member with the ratcheting lock 57.

After use, the extending member of each drawer locking device of the present invention can be detached from the base member and kept in the drawer, along with the lock device, to restore the full and normal function of the drawer. The extending member can be attached again to the base member for a next use. When the drawer locking device is no longer needed for a specific drawer, such as when the user is no longer staying in that location (such as moving out of a dorm or a hotel), the base member can also be detached from the inside surface 11*i* of the dresser top 11, or the base member can be left affixed at the inside surface 11*i*, without harming the use or the look of the drawer and the furniture.

Figure 15:
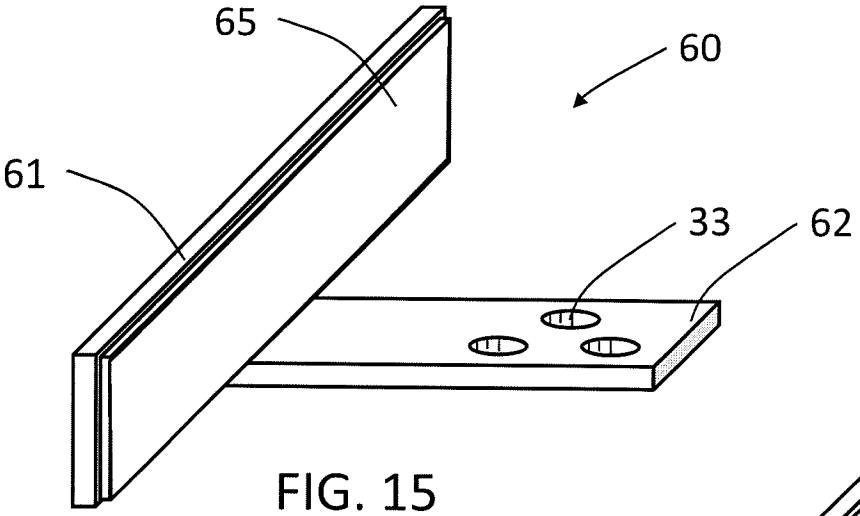
FIG. 15 shows a second embodiment of an extending member of a drawer locking device.
Figure 16:
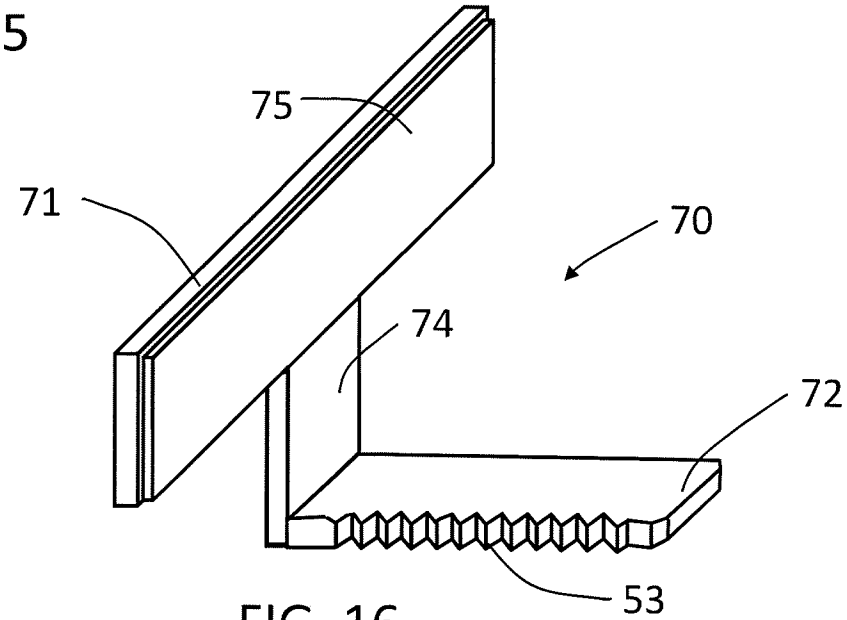
FIG. 16 shows an alternative to the second embodiment of the extending member of the drawer locking device.

A second embodiment of a drawer locking device of the present invention is shown in FIGS. 15 and 16, which illustrate a vertically-attaching extending member, including a forward-facing attaching end portion and an elongated locking end portion. This embodiment can be used as a closure and locking means for the second style of dresser and drawer shown in FIG. 4.

The attaching end portion can comprise a first rectangular planar portion, and the locking end portion can comprise a second rectangular planar portion. A major dimension of the second rectangular planar portion can be oriented transverse to a major dimension of the first rectangular planar portion. The second rectangular planar portion can extend from the middle of an edge of the first rectangular planar portion. The first rectangular planar portion and the second rectangular planar portion can comprise a unitary plate. The first rectangular planar portion can be oriented in a plane that is perpendicular to a plane of the second rectangular planar portion, and an edge of the second rectangular planar portion can extend from the middle of an edge of the first rectangular planar portion.

Figure 17:
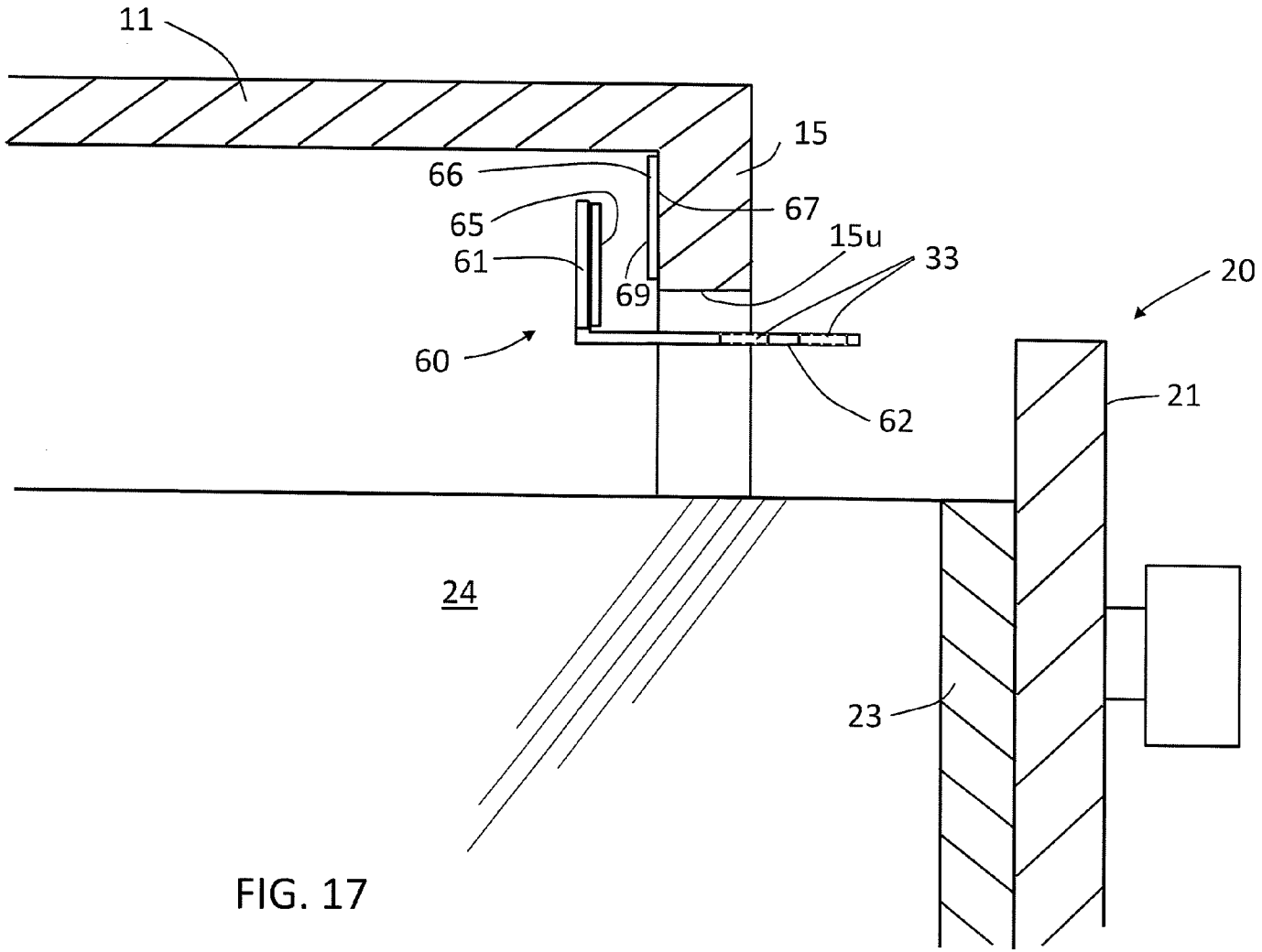
FIG. 17 shows the second embodiment of the drawer locking device being positioned for attachment to the inside of the second type of dresser and drawer.

FIG. 15 shows vertically-attaching extending member 60, including a lateral forward-facing attaching portion 61 including an attachment member 65 oriented in a laterally-extending vertical plane, and an elongated locking end portion 62 that extends horizontally from the bottom of the forward-facing attaching portion 61. The attachment member 65 preferably has a mechanical fastener. The elongated locking end portion 62 typically is integral with, and extends from substantially near the middle of the bottom edge of, the forward-facing attaching portion 61. The dimension of the elongated locking end portion 62, from the attachment member 65 to a locking means, illustrated as one or more locking holes 33, is configured or designed to be substantially the thickness of the top rail 15. FIG. 17 also shows the base member 66 having the adhesive layer surface 67 and the attachment member 69, preferably a layer of mechanical fastener.

It is understood that the teeth locking engaging elements, illustrated in FIG. 11 as elements 53, can be joined to the attachment member 65 of FIG. 15.

FIG. 16 shows an alternative vertical-attaching extending member 70, in which the elongated locking end portion 72 also includes a vertically extending portion 74 that is joined to the bottom of the lateral attaching end portion 71. This provides a greater vertical extension of the lateral portion 71 from the extending locking end portion 72. This embodiment alternatively illustrates the locking means as lock engaging teeth 53, described in earlier embodiments.

The vertical and horizontal, adjacent portions of the extending members are typically integrally or unitarily formed (that is, cast, formed or molded in one piece).

Figure 18:
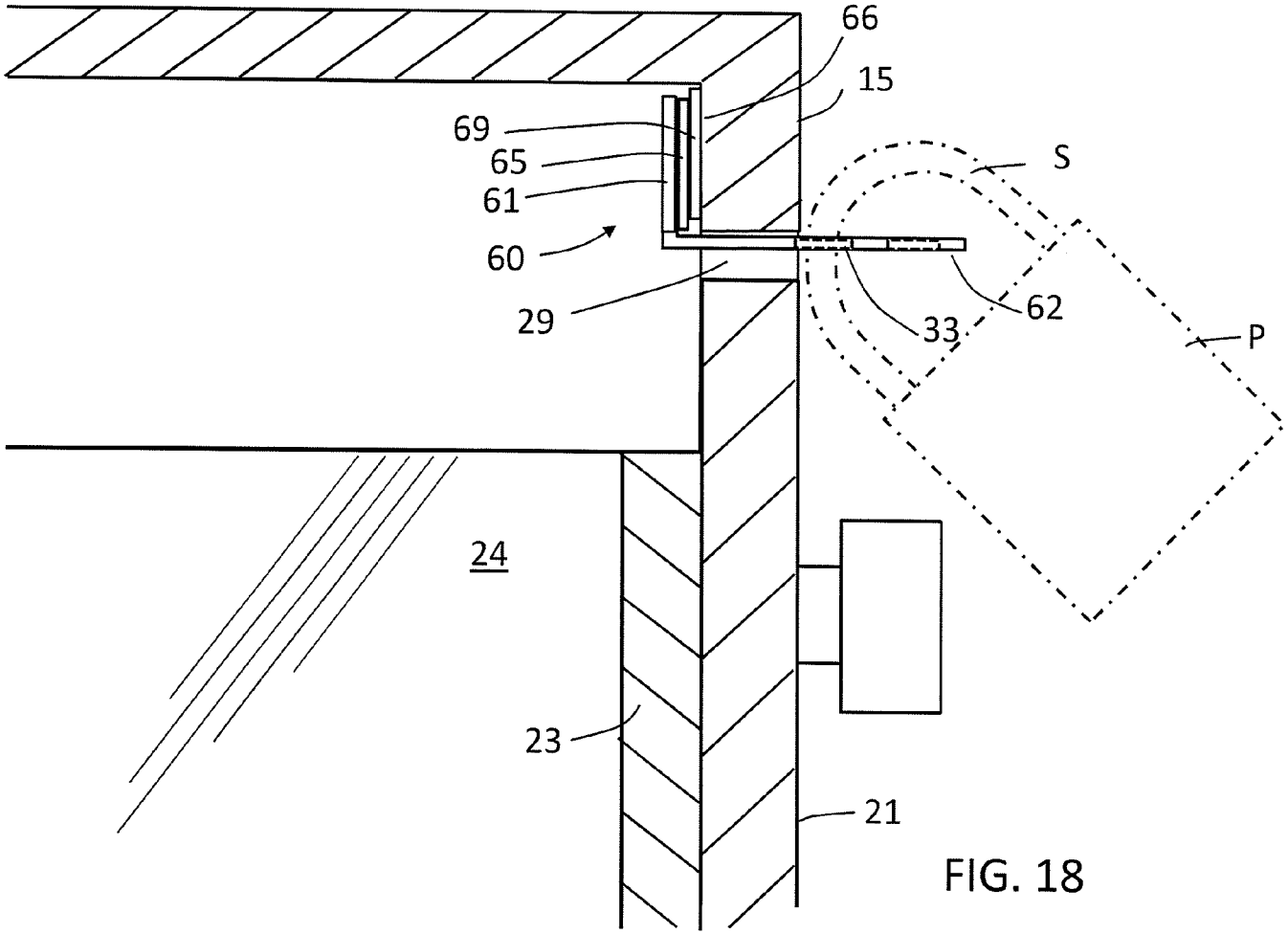
FIG. 18 shows the second embodiment of the drawer locking device attached and locked, using a padlock, to the second type of dresser with the drawer closed.

As illustrated in FIGS. 17 and 18, the second embodiment of the drawer locking device can be used for locking closed a drawer, in the second dresser and drawer type shown in FIG. 4. With the drawer 20 pulled open, the user first secures the base member 66 to the inner surface of the downward-extending top rail 15 of the dresser. The adhesive-layered surface 67 of the base member 66 is positioned facing forward toward the inner surface of the top rail 15, with the long dimension of the elongated base member 66 oriented horizontally and approximately parallel with the top rail 15. The adhesive surface 67 is then pressed forward to secure the base member 66 onto the inner surface of the top rail 15. The adhesive-layered surface 67 may be covered with a release paper (not shown), which is removed prior to securing the base member 66 to the dresser. The base member 66 is intended to remain secured to the dresser for so long as the user chooses. Under normal use of the drawer, the base member is not visible from outside the dresser.

When the user wants to lock the drawer closed, the drawer 20 is pulled opened, and the vertical-attaching extending member 60 is attached to the base member 66. The user orients the angled extending member 60 with the locking end portion 62 extending outward in the direction of drawer opening, and the first attachment member 65 facing forward toward the mating attachment second member 69 of the base member 66. Aligning the angled extending member 60 is done to maximize the registry of the two attachment members 65 and 69. The top face of the vertical-attaching extending member 60 is pressed forward for mechanical fastening to the base member 66 while the top face of the locking end portion 62 is positioned as close as possible to the bottom face 15*u* of the top rail 15 in order to facilitate the closure of drawer 20. After the drawer 20 is closed, as shown in FIG. 18, the locking end portion 62 extends through the gap 29 between the drawer face 21 and the top rail 15. The shackle S of a conventional padlock P can then be passed through one of the locking holes 33, and locked. With the shackle of the padlock positioned close to the front face 21 of the drawer, there is very little space for pulling open the drawer.

In a similar way, the alternative vertical-attaching extending member 70 shown in FIG. 16 employing a ratcheting lock can be attached to the base member 66 for locking the drawer.

Figure 20:
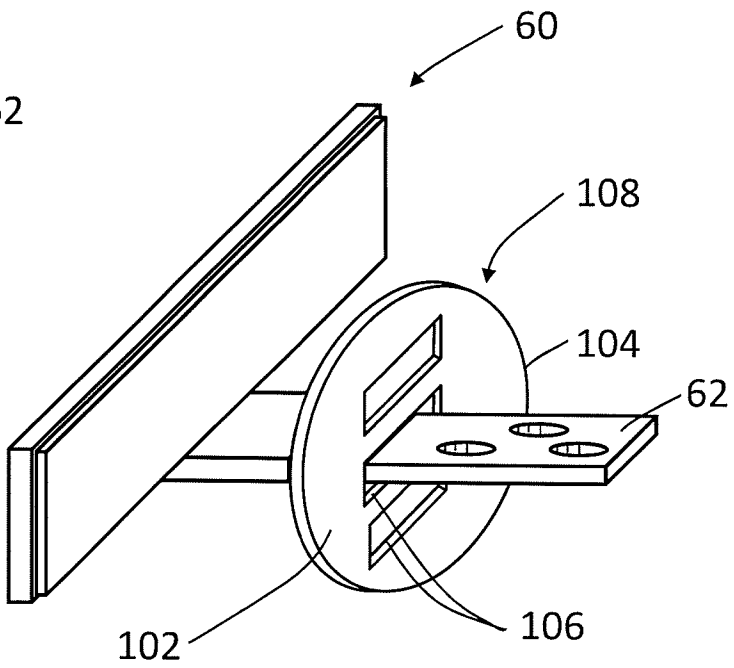
FIG. 20 shows an alternative embodiment of a shield.
Figure 19:
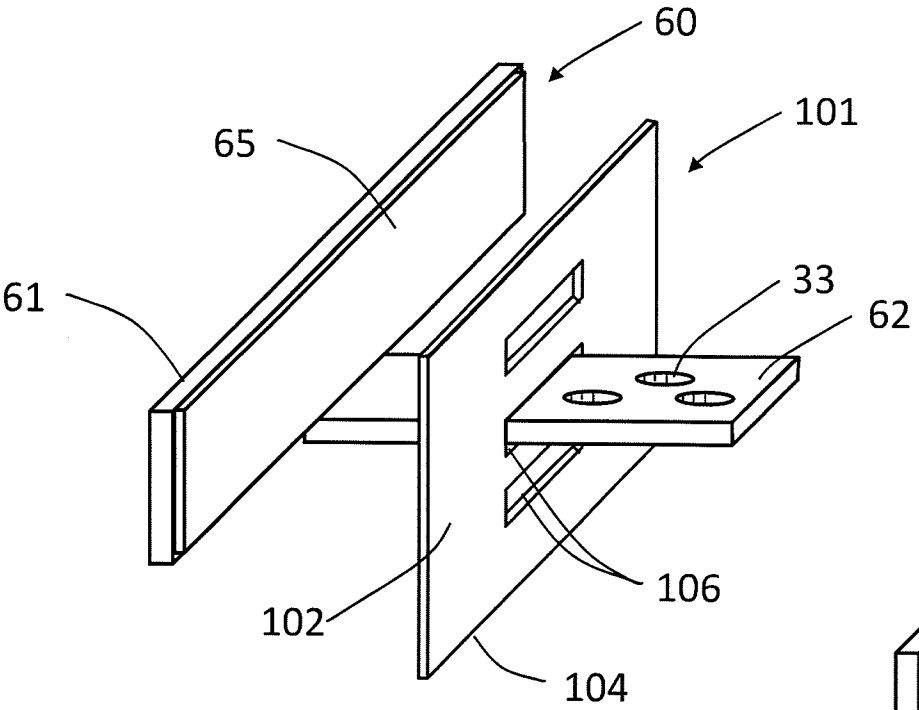
FIG. 19 shows a shield for use with a drawer locking device of the invention to improve the locking of the drawer closed.
Figure 21:
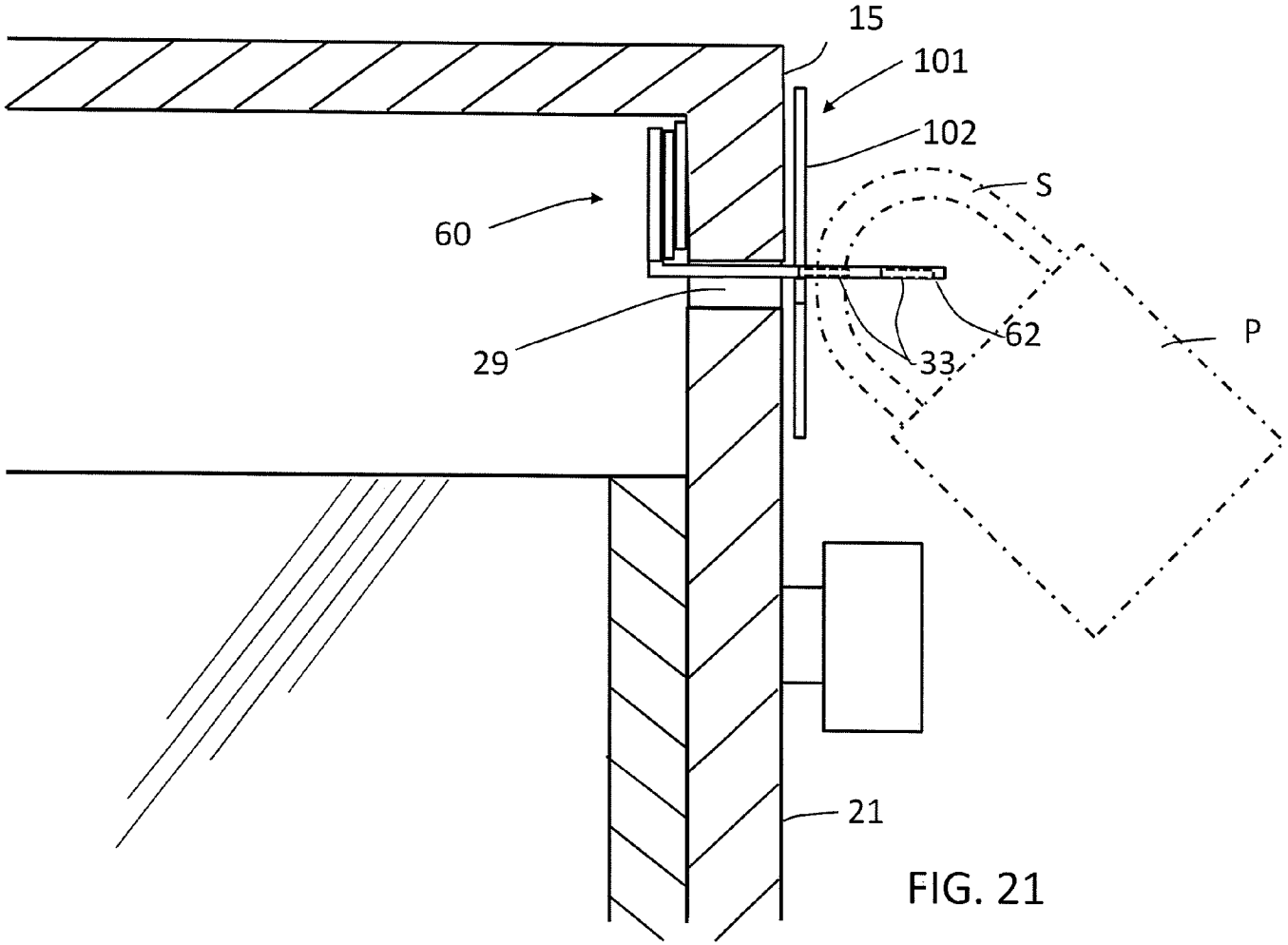
FIG. 21 shows the shield installed on the locking device of FIG. 18.

In any of the embodiments of the extending member and their use as described herein, and for example as shown in FIGS. 19 and 20, it may be desirable to place a shield over the end of the locking end portion 62 protruding outward through the gap 29 between the dresser and the drawer, before applying the lock device. FIG. 19 shows a shield 101 as a rectangular plate 102 having a substantially planar body and a periphery 104, and including one or more openings 106, illustrated as rectangular slots, to accommodate passing therethrough of the locking end portion 62 of the drawer locking device 60. Typically the opening 106 is disposed approximately near or at the center of the plate 102, and can have any shape to narrowly accommodate the locking end portion 62, such that substantial movement (up and down, or side to side, or rotational) of the shield 101 is not permit when disposed on the locking end portion 62. A plurality of openings 106 can be provided in the shield to adjust the placement of the lock device along the locking end portion. When used, the shield 101 is positioned along the extending locking end portion, inboard of the locking means (P). The periphery 104 of the shield extends away from the opening 106 a distance sufficient to block and prevent the drawer front face 21 from being opened beyond the shield 101 and the locking means (P), as shown in FIG. 21. FIG. 20 shows an alternatively shaped shield 108, having an oval or circular shape. The planar surfaces of the shield can be coated with a plastic material to reduce chipping or scratching of the wooden surfaces of the dresser and drawer. The shield plate 101,108 provides a better securement of the closed drawer and protection of the front face 21 of the drawer from potential damage caused by constant or repeated direct contact with the padlock. The shield is particularly suitable for use with padlocks. The shield can also be used with a ratcheting lock.

Figure 22A:
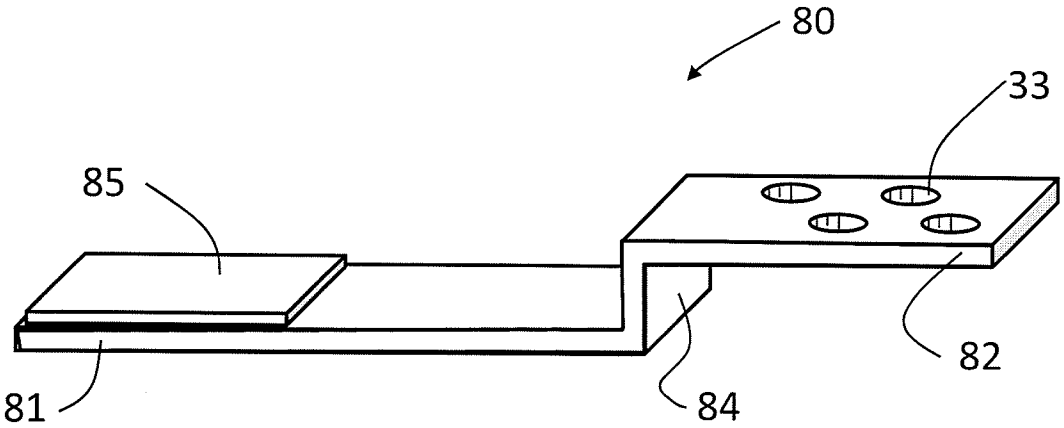
FIG. 22A shows a third embodiment of an extending member of a drawer locking device.
Figure 23:
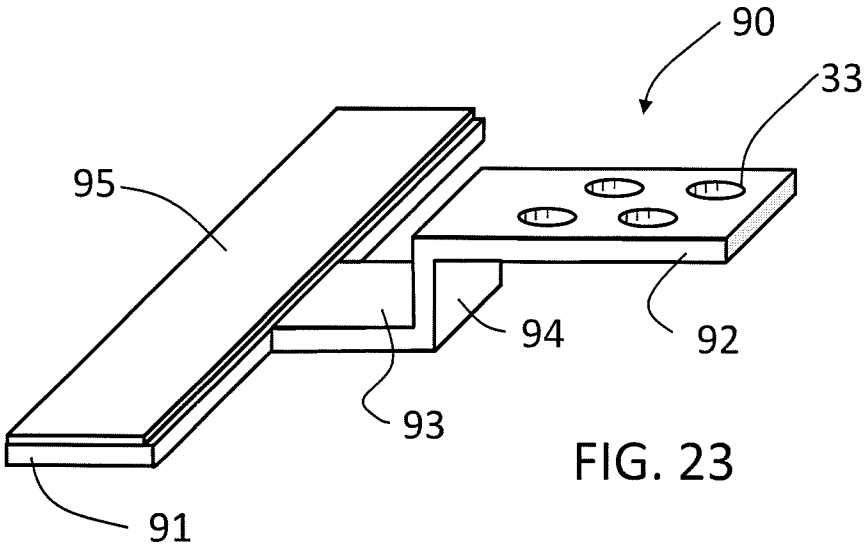
FIG. 23 shows an alternative to the third embodiment of the extending member of the drawer locking device.
Figure 22B:
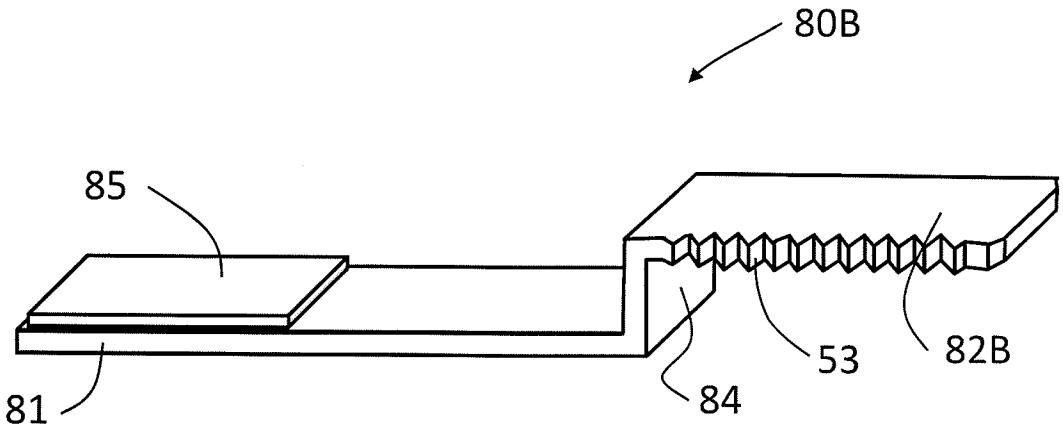
FIG. 22B shows an alternative to the third embodiment of an extending member of a drawer locking device with an extending member configured for a ratcheting lock.

A third embodiment of a drawer locking device of the present invention is shown in FIGS. 22A, 22B, and 23. This embodiment can be used as a closure locking means for the third style of dresser opening and drawer shown in FIG. 5.

The attaching end portion can comprise a first rectangular planar portion, and the locking end portion can comprise a second rectangular planar portion. A major dimension of the second rectangular planar portion can be oriented transverse to a major dimension of the first rectangular planar portion. The second rectangular planar portion can extend from the middle of an edge of the first rectangular planar portion. The first rectangular planar portion and the second rectangular planar portion can comprise a unitary plate. The second rectangular planar portion can extend in a plane different from a plane through the first rectangular planar portion, and an intermediate planar portion can connect a forward edge of the first rectangular planar portion with a rearward edge of the second rectangular planar portion. The intermediate planar portion and the second rectangular planar portion can extend from the middle of a forward edge of the first rectangular planar portion. The first rectangular planar portion, the second rectangular planar portion, and the intermediate planar portion can comprise a unitary plate.

FIG. 22A shows an extending member 80, including an attaching end portion 81 that releasably attaches to a base member, a rising portion 84 joined at a bottom edge to a distal end of the attaching end portion 81, and a locking end portion 82 joined to the top edge of the rising portion 84. The locking end portion 82 and the attaching end portion 81 are aligned in the same direction. The rising portion 84 forms a step that rises up and over the top edge of the front face 21 of the drawer 20, as shown in FIGS. 24 and 25A.

Figure 24:
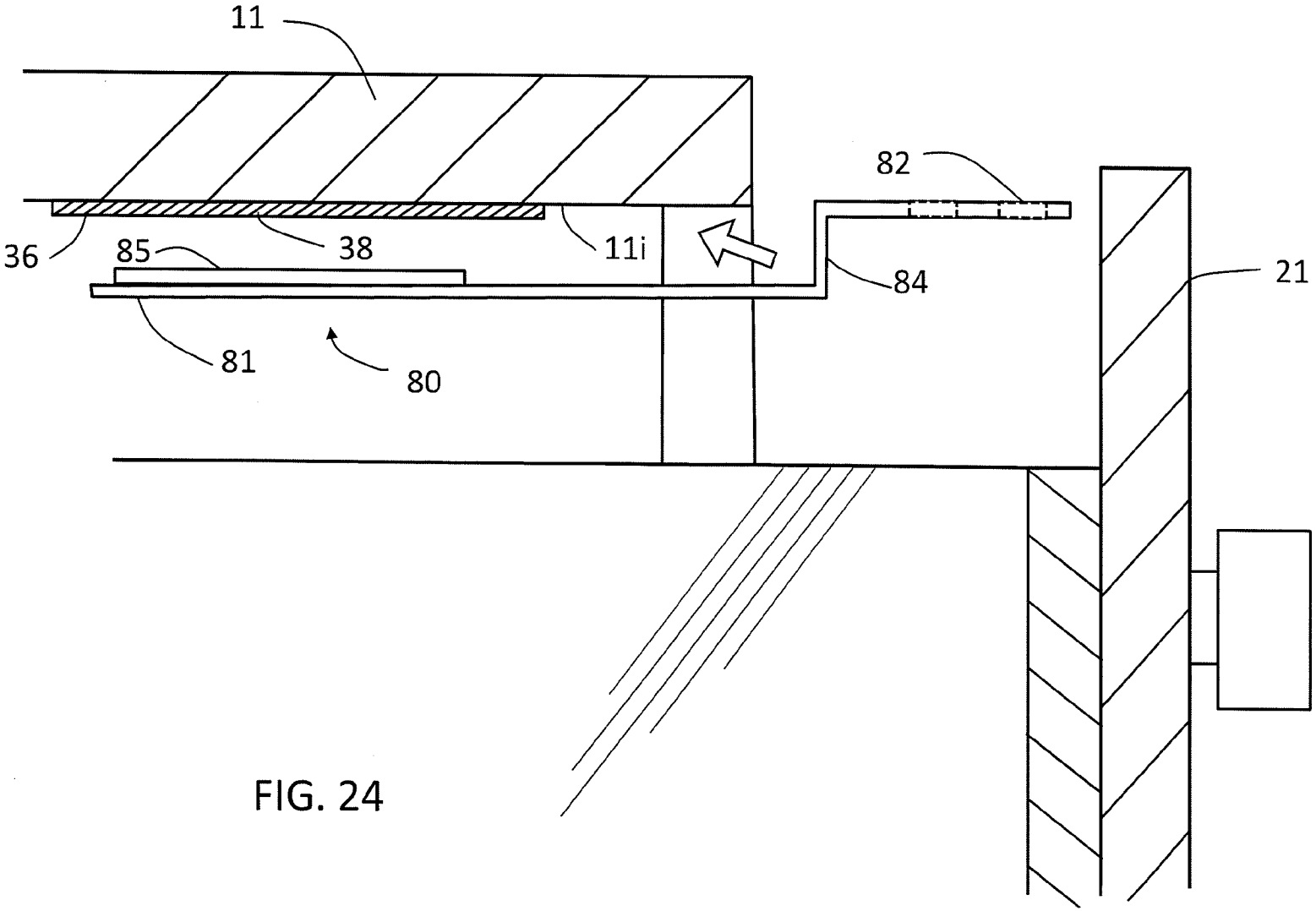
FIG. 24 shows the third embodiment of the drawer locking device being positioned for attachment to the inside of the third type of dresser and drawer.
Figure 25A:
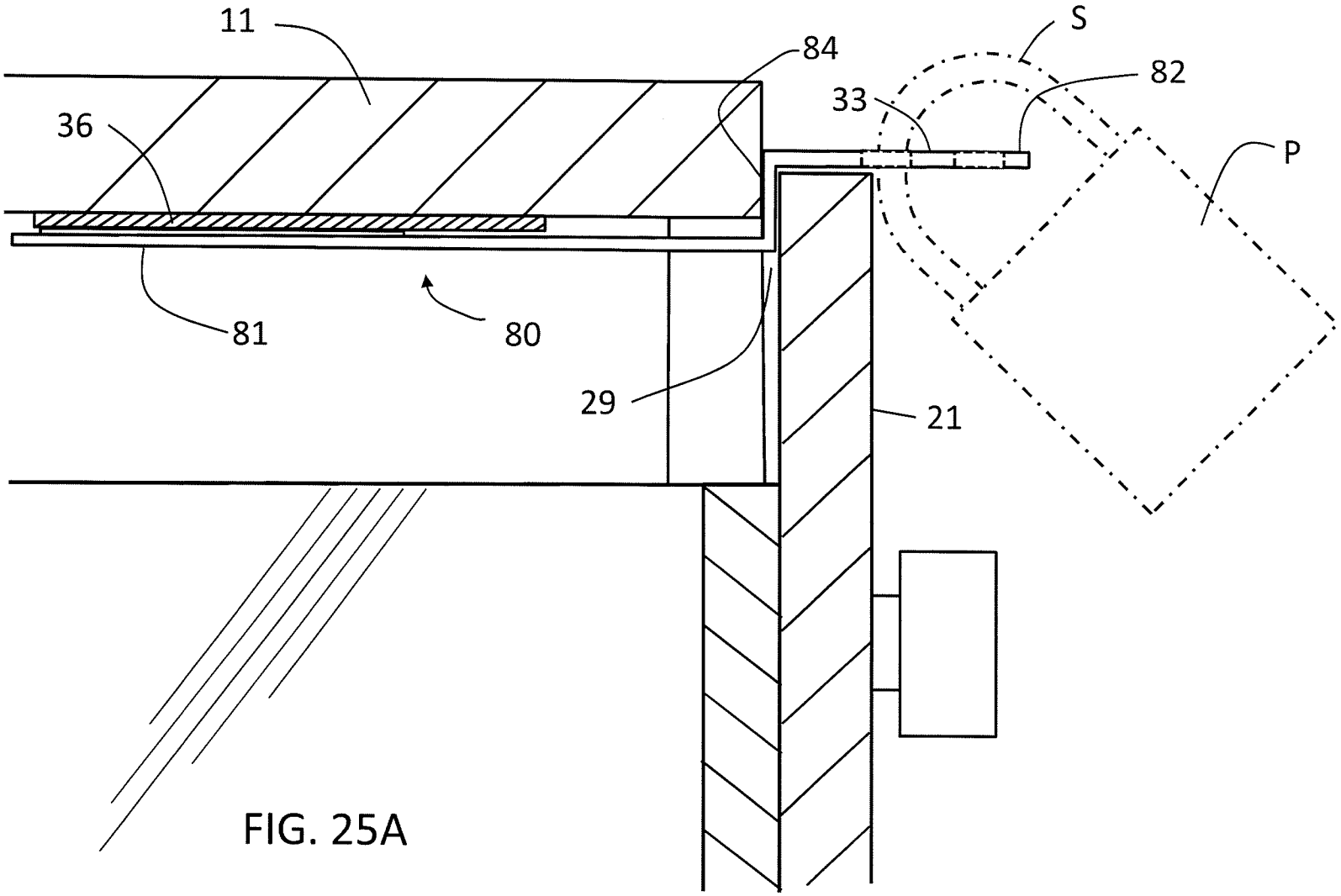
FIG. 25A shows the third embodiment of the drawer locking device of FIG. 22A attached and locked to the third type of dresser and drawer with the drawer closed.

Installing the device of the third embodiment into an open drawer and dresser of the third type (shown in FIG. 5) is substantially as was described for the earlier embodiments, and is illustrated in FIGS. 24 and 25A. In this embodiment, the rising portion 84 should be positioned as close as possible to the forward edge of the top 11 before pressing the first mechanical fastener 85 against the second (base) mechanical fastener 38 fixed in order to improve the closure of the drawer 20, typically by resting the rising portion 84 against the forward edge of the top 11 as the first mechanical fastener 85 is pressed upward.

An alternative embodiment 90 is shown in FIG. 23, which is substantially the same as the third embodiment 80 shown in FIG. 22, except that the extending member has a "T" shape. A cross-member part 91 forms the "T" shape with elongated portion 93 that is joined to the bottom edge of the rising portion 94.

The use of a shield 101, as shown in FIG. 21 can improve the security of the locked closure of this embodiment.

Figure 25B:
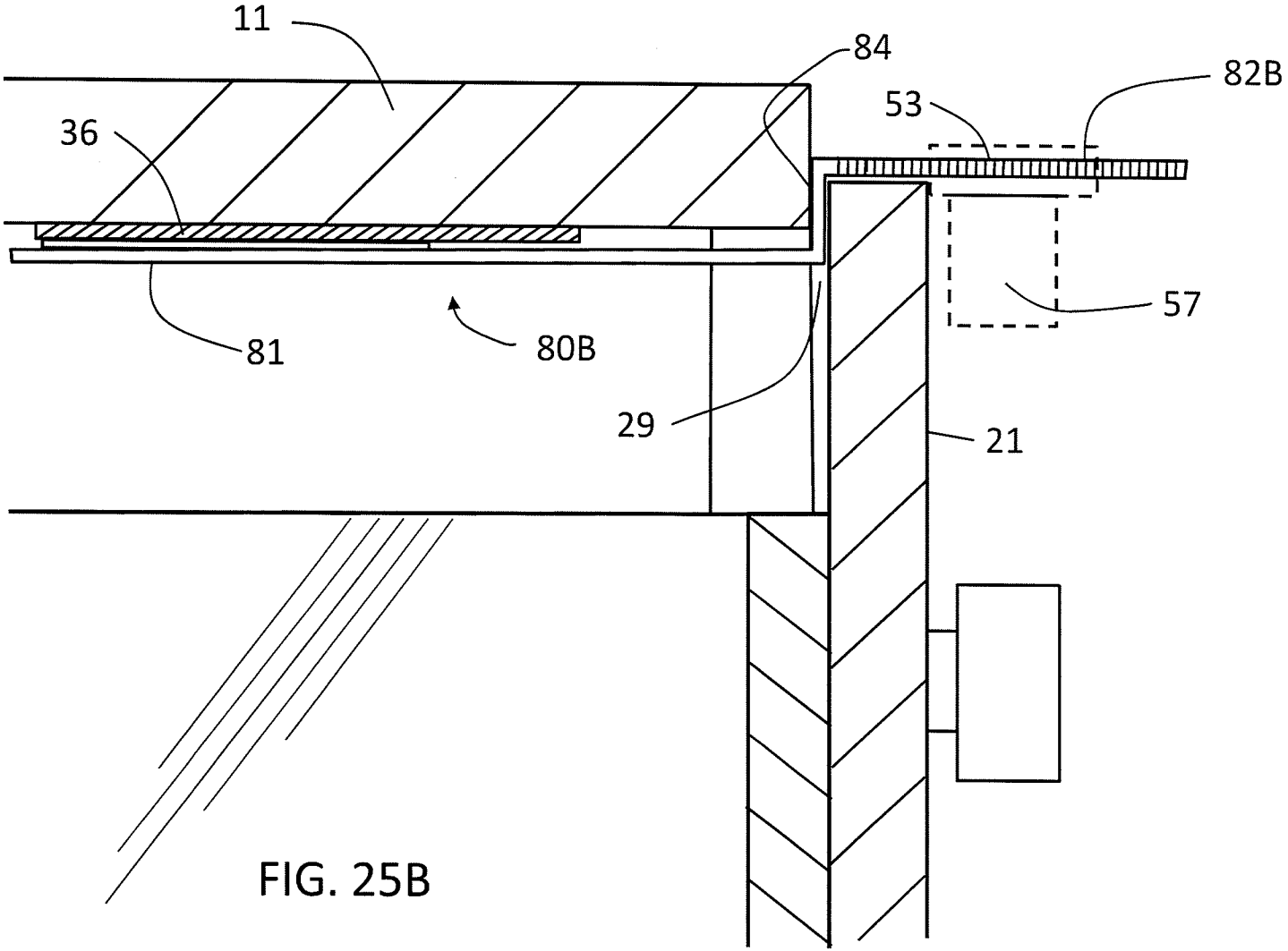
FIG. 25B shows the alternative of the third embodiment of the drawer locking device of FIG. 22B with an extending member configured for the ratcheting lock, attached and locked to the third type of dresser and drawer with the drawer closed.

A preferred embodiment 80B is shown in FIG. 22B, which is substantially the same as the embodiment of FIG. 22, except that the locking end portion 82B has a plurality of lock engaging teeth 53 to latch in the ratcheting lock 57. The ratcheting lock 57 can provide a better grip of the top edge of the front face 21 of the drawer 20, and allow a tighter and more secure closure of the drawer, as shown in FIG. 25B.

Figure 26A:
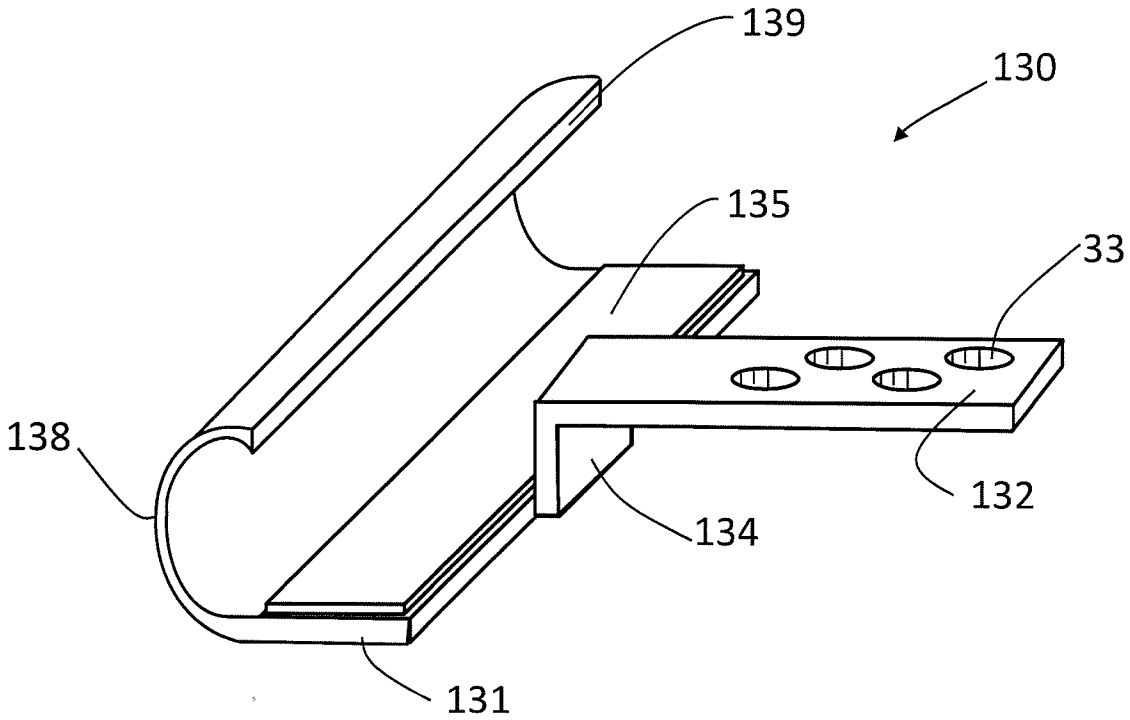
FIG. 26A shows a fourth embodiment of an extending member of a drawer locking device.
Figure 27:
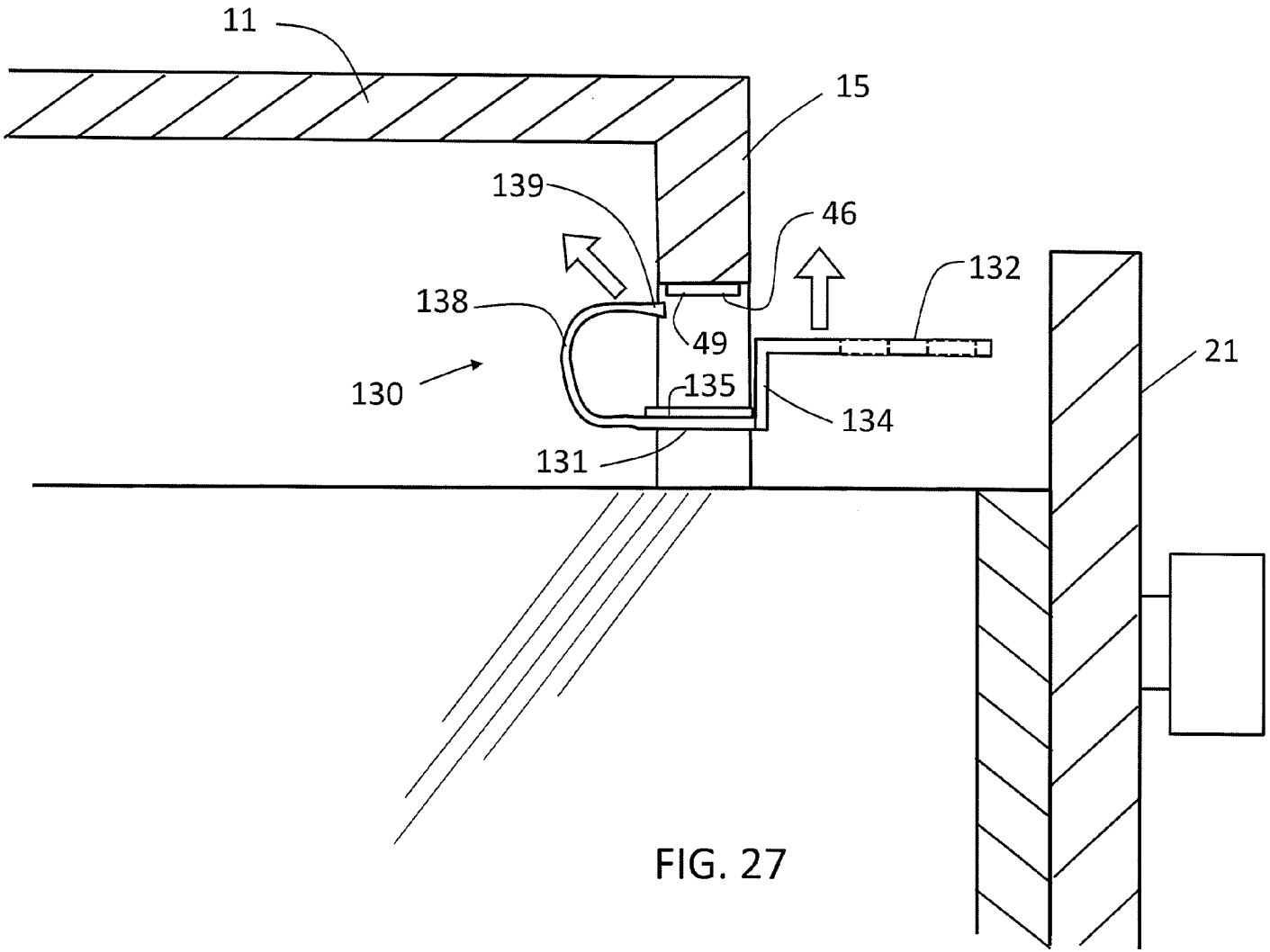
FIG. 27 shows the fourth embodiment of the drawer locking device of FIG. 26A being positioned for attachment to the inside of the fourth type of dresser and drawer.

A fourth embodiment of a drawer locking device of the present invention is shown in FIGS. 26A and 27, which illustrate a spring-walled extending member 130. This embodiment can be used as a closure locking means for the fourth style of dresser opening and drawer shown in FIG. 6.

The attaching end portion can comprise a first rectangular planar portion, and the locking end portion can comprise a second rectangular planar portion. A major dimension of the second rectangular planar portion can be oriented transverse to a major dimension of the first rectangular planar portion. The second rectangular planar portion can extend from the middle of an edge of the first rectangular planar portion. The first rectangular planar portion and the second rectangular planar portion can comprise a unitary plate. The second rectangular planar portion can extend in a plane different from a plane through the first rectangular planar portion, and an intermediate planar portion can connect a forward edge of the first rectangular planar portion with a rearward edge of the second rectangular planar portion. The intermediate planar portion and the second rectangular planar portion can extend from the middle of a forward edge of the first rectangular planar portion. The first rectangular planar portion, the second rectangular planar portion, and the intermediate planar portion can comprise a unitary plate. The spring wall can extend from a rearward edge of the first rectangular planar portion, opposite the forward edge of the first rectangular planar portion.

FIGS. 26A and 27 show the spring-walled extending member 130, including a lateral attaching portion 131 having an attachment member 135 oriented in a laterally-extending horizontal plane that extends about the thickness of the top rail 15 of a dresser, and can be releasably attached to a laterally-extending base member 46 fixed to the under edge of the top rail 15. The spring-walled extending member 130 also includes a rising portion 134 joined to the distal (forward) edge of the lateral attaching portion 131, and a locking end portion 132 joined to the top edge of the rising portion 134. The rising portion 134 forms a step that rises up and over the top edge of the front face 21 of the dresser drawer 20, by the amount that the front face 21 overlaps the top rail 15, as shown in FIG. 28A.

The device 130 also includes a curved, resilient rearward wall 138 that attaches to and extends from the lateral attaching portion 131. The wall has resilience to flex when a force is applied to a distal edge 139. The distal edge 139 of the curved rearward wall 138 is biased rearwardly upon engagement with the inner surface of the top rail 15, as shown in FIGS. 27 and 28A.

Figure 28A:
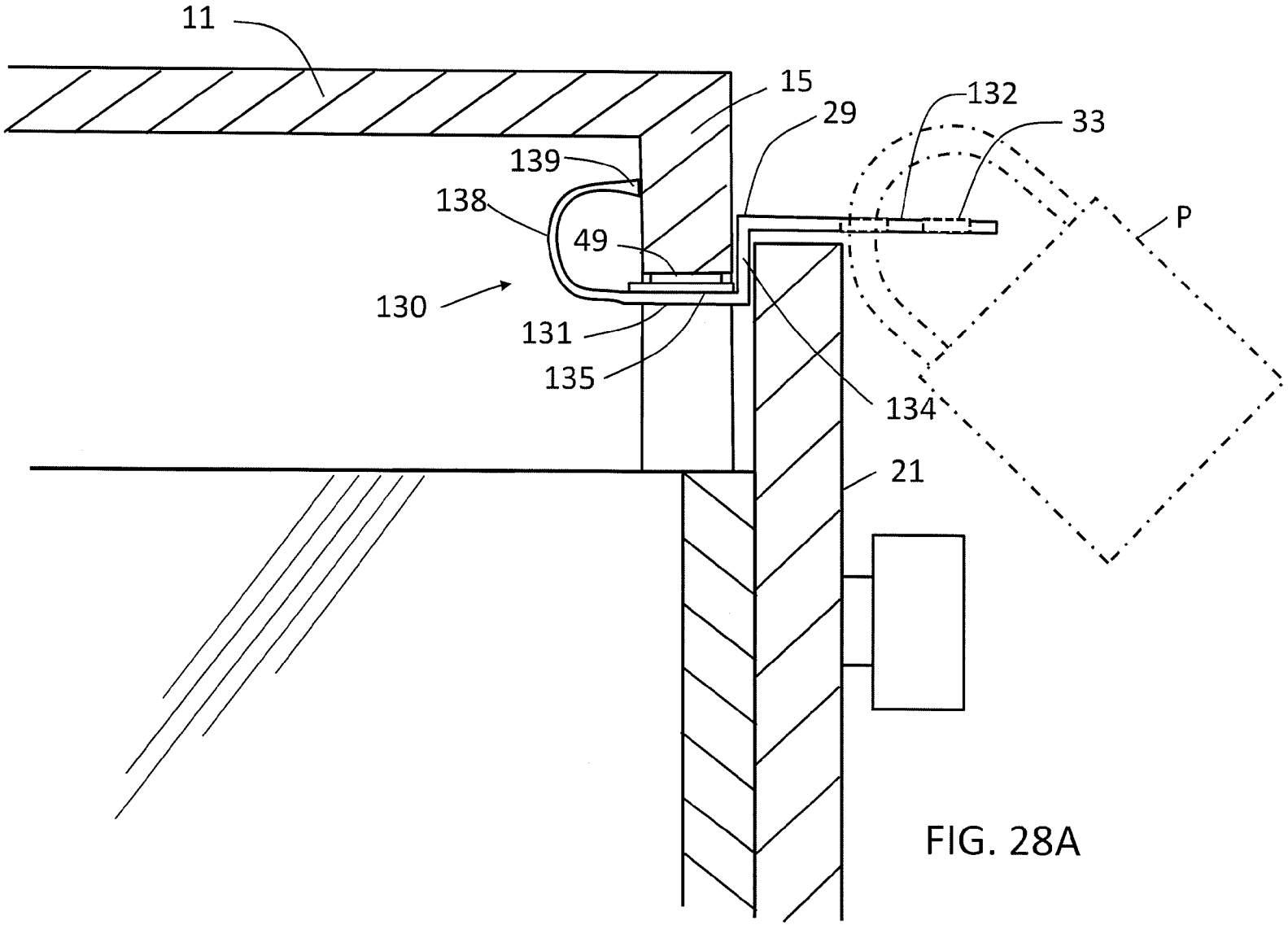
FIG. 28A shows the fourth embodiment of the locking device of FIG. 26 attached and locked to the fourth type of dresser and drawer with the drawer closed.

Installing the device of the fourth embodiment into an open drawer and dresser of the fourth type (shown in FIG. 6) is substantially as was described for the earlier embodiments, and is illustrated in FIGS. 27 and 28A. In this embodiment, the curved rearward wall 138 and the rising portion 134 clamp the top rail 15. During installation, the distal edge 139 of the curved wall 138 is rested against the inner surface of the top rail 15, and biased rearwardly, as the attachment member 135 is pressed upward to engage the second mechanical fastener 49 of the laterally-extending base member 46. Once the drawer locking device is positioned, the drawer 20 is closed and the lock device, illustrated as a padlock, is secured to the locking holes 33 in locking end portion 132.

The use of a shield 101, as shown in FIG. 21, can improve the security of the locked closure of this embodiment.

Figure 26B:
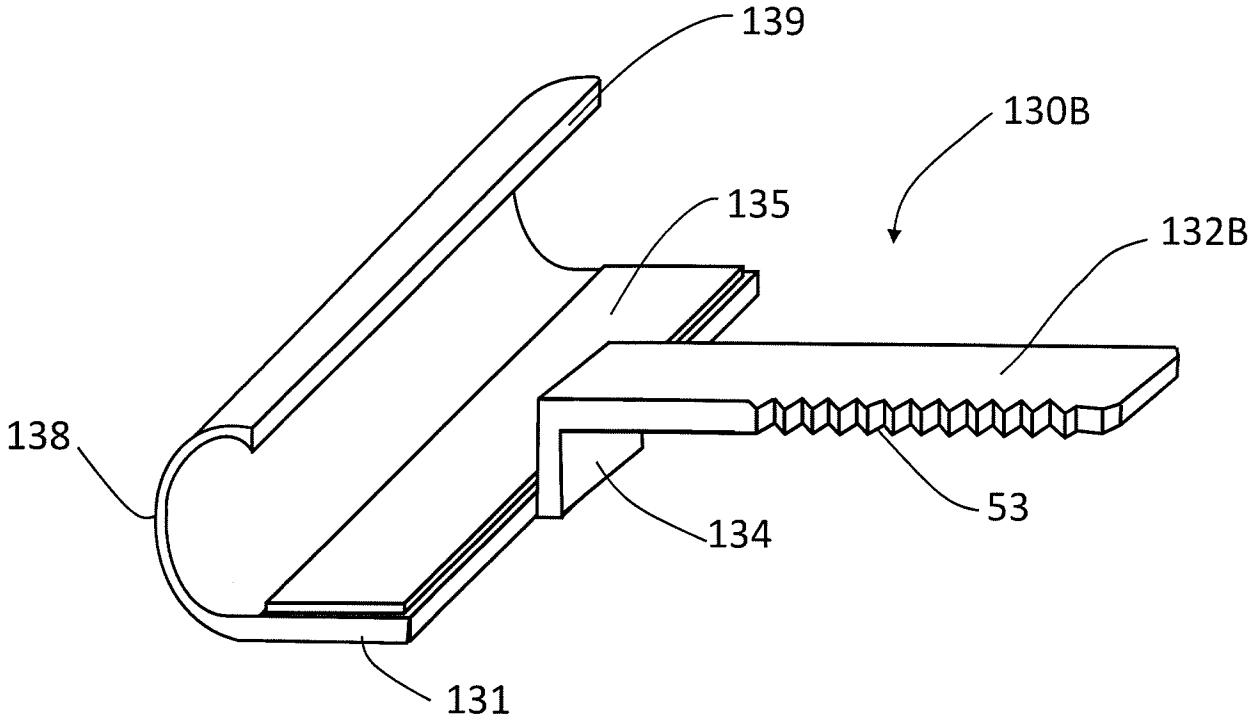
FIG. 26B shows an alternative to the fourth embodiment of an extending member of a drawer locking device with an extending member configured for a ratcheting lock.
Figure 28B:
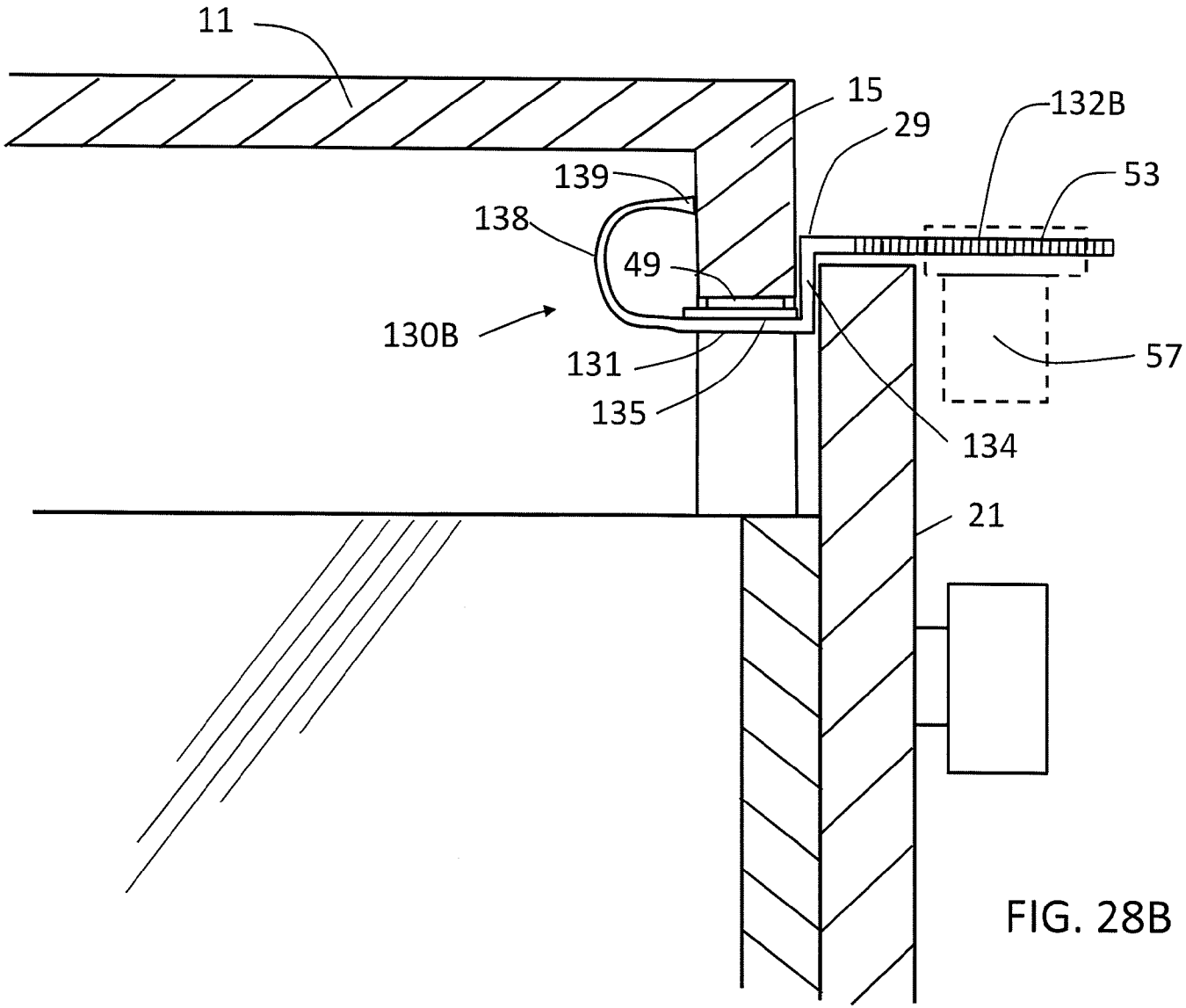
FIG. 28B shows the alternative of the fourth embodiment of the locking device of FIG. 26B with an extending member configured for the ratcheting lock, attached and locked to the fourth type of dresser and drawer with the drawer closed.

An alternative embodiment 130B is shown in FIG. 26B, which is substantially the same as the embodiment 130, except that the locking end portion 132B has a plurality of lock engaging teeth 53 to latch in the ratcheting lock 57. The ratcheting lock 57 can provide a better grip of the top edge of the front face 21 of the drawer 20, and allow a tighter and more secure closure of the drawer, as shown in FIG. 28B.

Figure 29:
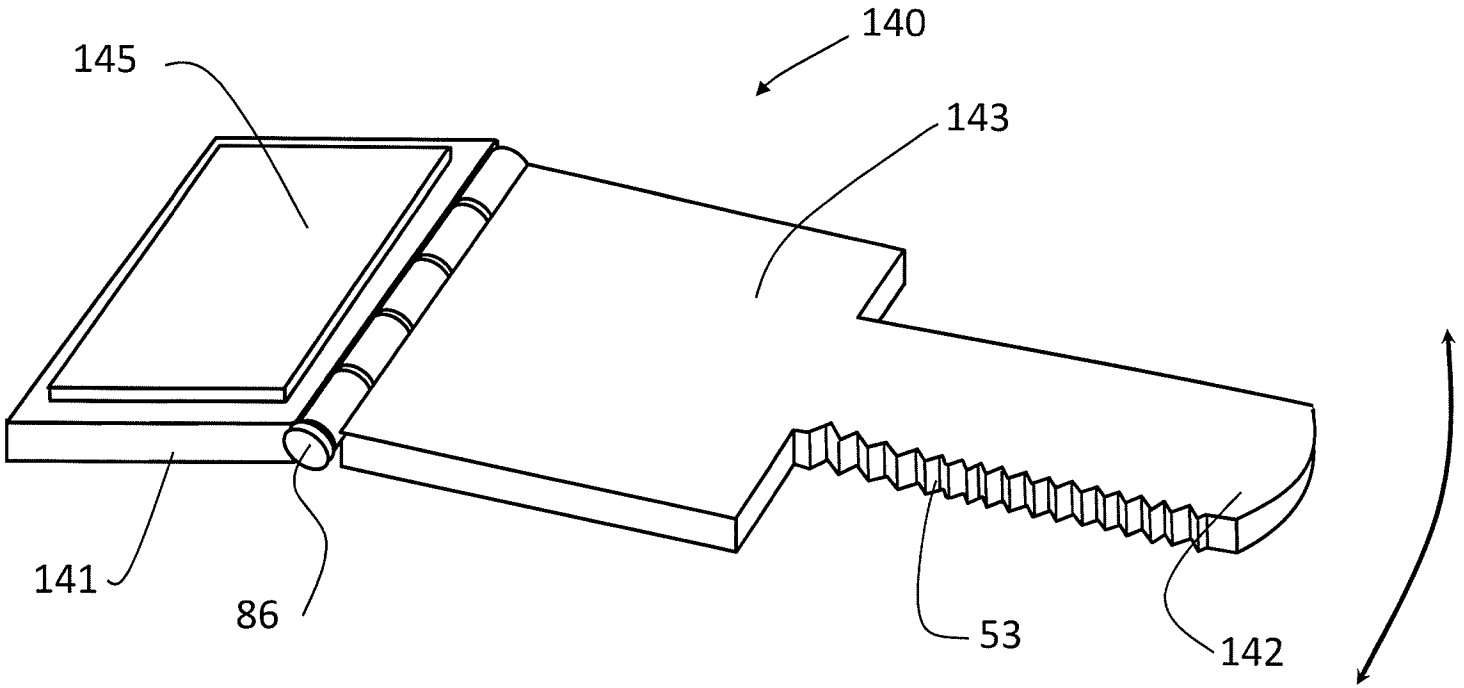
FIG. 29 shows a fifth embodiment of a drawer locking device employing a hinge.

A fifth embodiment of a drawer locking device of the present invention is shown in FIG. 29, which illustrates an extending member that includes a hinge between the attaching portion and the locking end portion. This embodiment can be used as a closure locking means for the first and the third styles of dresser opening and drawer shown in FIGS. 3 and 5.

The attaching end portion can comprise a first rectangular planar portion, and the locking end portion can comprise a second rectangular planar portion. A major dimension of the second rectangular planar portion can be oriented transverse to a major dimension of the first rectangular planar portion. The second rectangular planar portion can extend from the middle of an edge of the first rectangular planar portion. The second rectangular planar portion is joined along an edge by a hinge to an edge of the first rectangular planar portion.

FIG. 29 shows an extending member 140 including an attaching portion 141 that includes an attachment member 145, the attaching portion 141 being hinged to the locking end portion 142. The locking end portion can include a wider portion 143 extending from the hinge 86 and extending toward, and narrowing to, the locking end portion 142. The hinge 86 can be any hinging means, including, but not limited to a butt hinge, a piano hinge and a butterfly hinge, and a living (plastic) hinge. The dimensions of the attaching portion 141 are shown rectangular, with the longer side disposed lateral to the extending direction. It can be understood that the attaching portion can be made even more laterally extending (a larger lateral width) or more elongated (a larger length in the opening direction) to suit the need.

Figure 30:
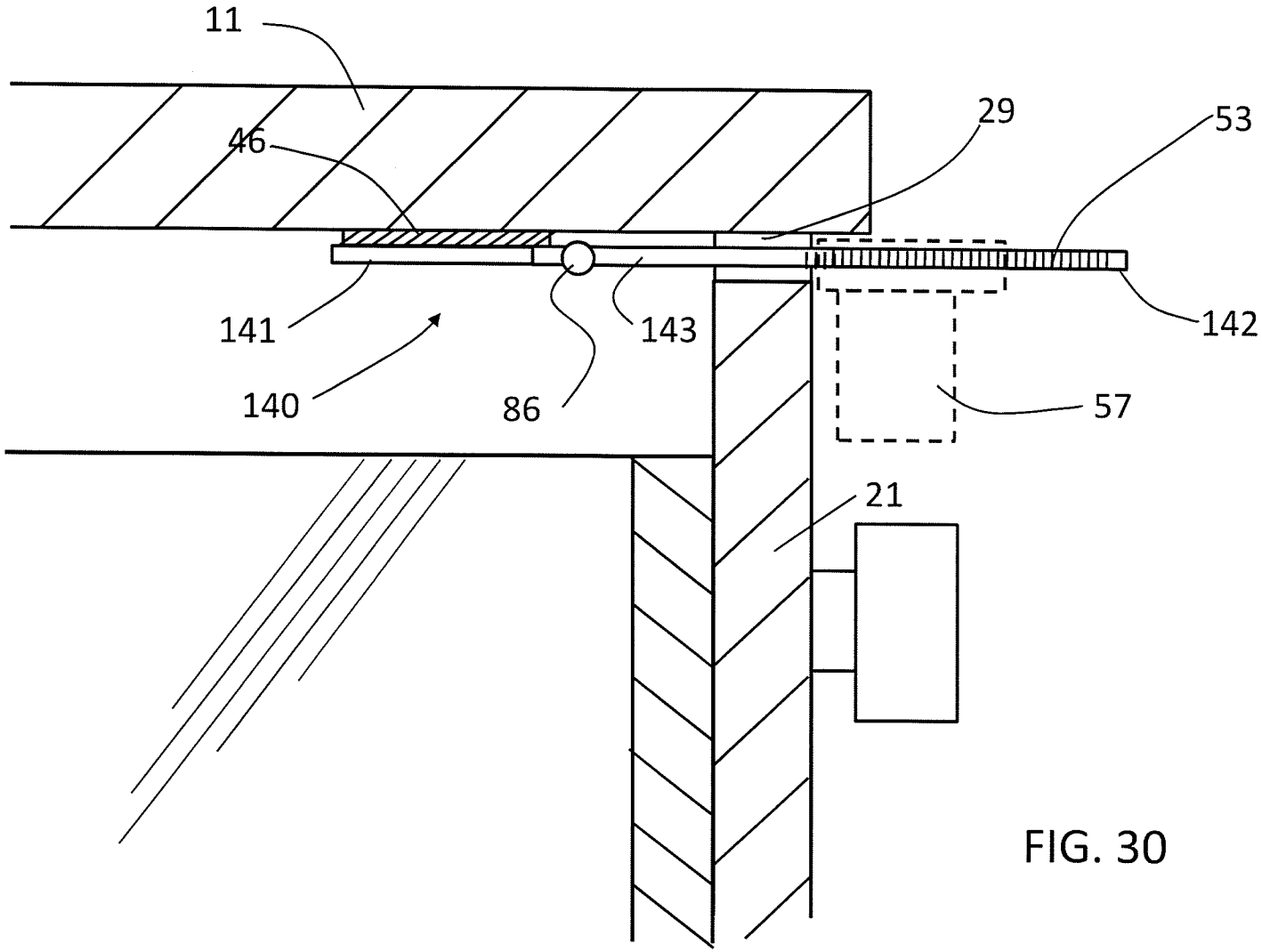
FIG. 30 shows the fifth embodiment of a drawer locking device of FIG. 29 installed and locked to the first type of dresser and drawer with the drawer closed.

The embodiment shown in FIG. 29 can be used with the first type of dresser-drawer designs of FIG. 3, as shown in FIG. 30.

Figure 31:
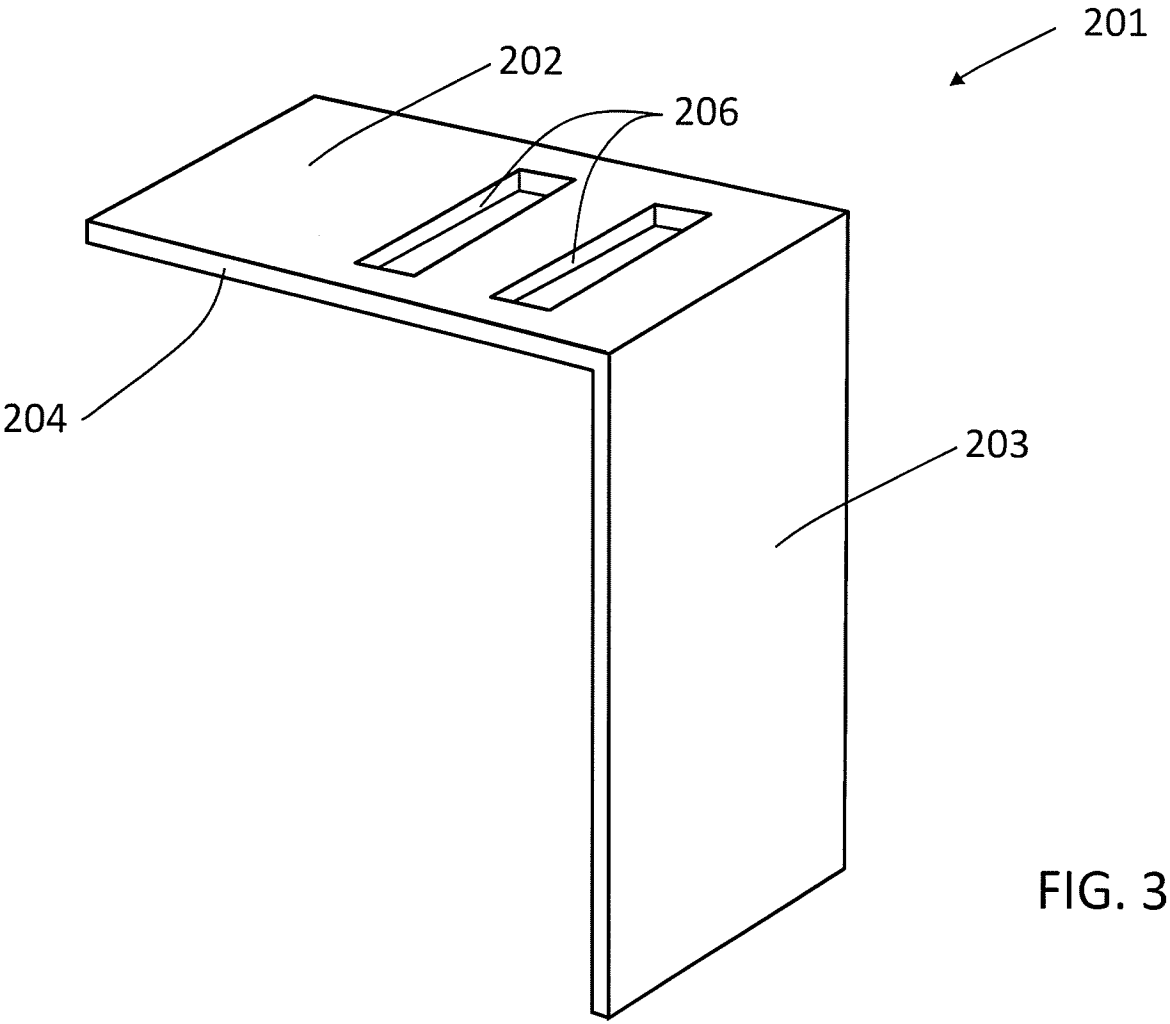
FIG. 31 shows another embodiment of a shield for use with a locking device of the invention to improve the locking of the drawer closed.

The drawer locking device embodiment shown in FIG. 29 can also be used with the third type of dresser-drawer design shown in FIG. 5, with the hinge 86 disposed proximate the gap 29 and the locking end portion 142 pointing upward through the gap 29. This aspect of the invention further includes a curved or angled shield plate, shown as shield 201 in FIGS. 31 and 32, that extends across the top 11 of the dresser, and downward over the front face 21 of the drawer. FIG. 31 illustrates a shield plate 201 having an angled shape, with a generally horizontal portion 202 having a periphery 204 and one or more slots 206 formed therethrough to accept the extending locking end 142 of the extending device 140, and an angled, planar portion 203 extends downward from one end of the horizontal portion, substantially perpendicularly.

Figure 32:
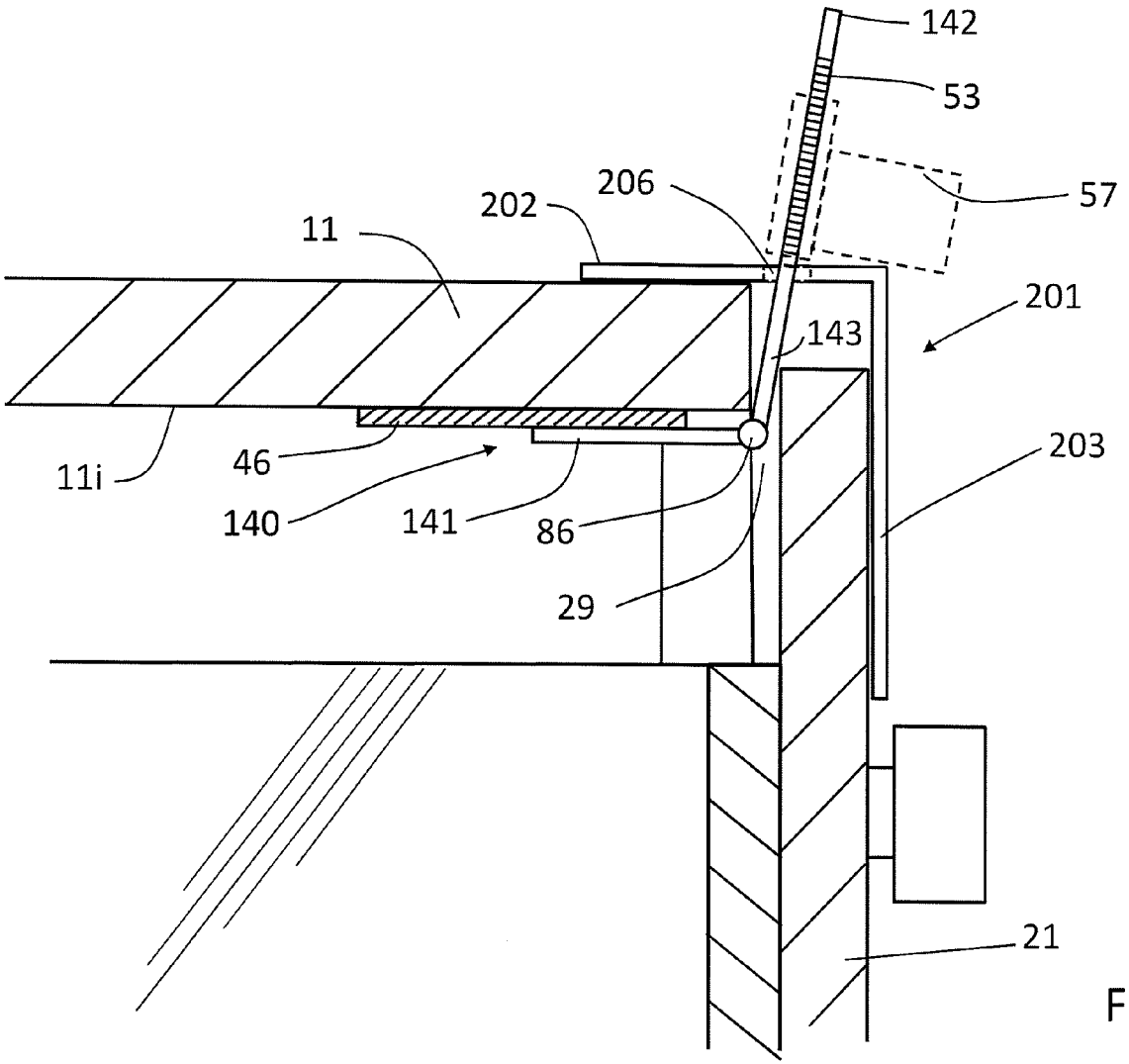
FIG. 32 shows the fifth embodiment of a locking device of FIG. 29 installed and locked to the third type of dresser and drawer with the drawer closed and using the shield embodiment of FIG. 31.

As shown in FIG. 32, the extending device 140 is positioned with the hinge 86 proximate the gap 29 and the locking portion 142 extending upwardly through the gap 29 between the top 11 and the front face 21 of the drawer. The distal end of the locking portion 142 and the lock engaging teeth 53 extend beyond the top surface of the top 11. With the drawer closed, the extending portion 142 is slid through a slot 206 of the horizontal portion 202 of the shield 201, and placed against the top surface of the dresser top 11, with the planar portion 203 extending downward over and along the outer vertical surface of the front face 21. Attachment of the lock device (illustrated as the ratcheting lock 57) to the locking end portion, pressed up to or against the shield 201, provides a secure closure. The surfaces of the shield and the locking portion can be coated with a plastic material to reduce any damage to the wooden surfaces.

Figure 33:
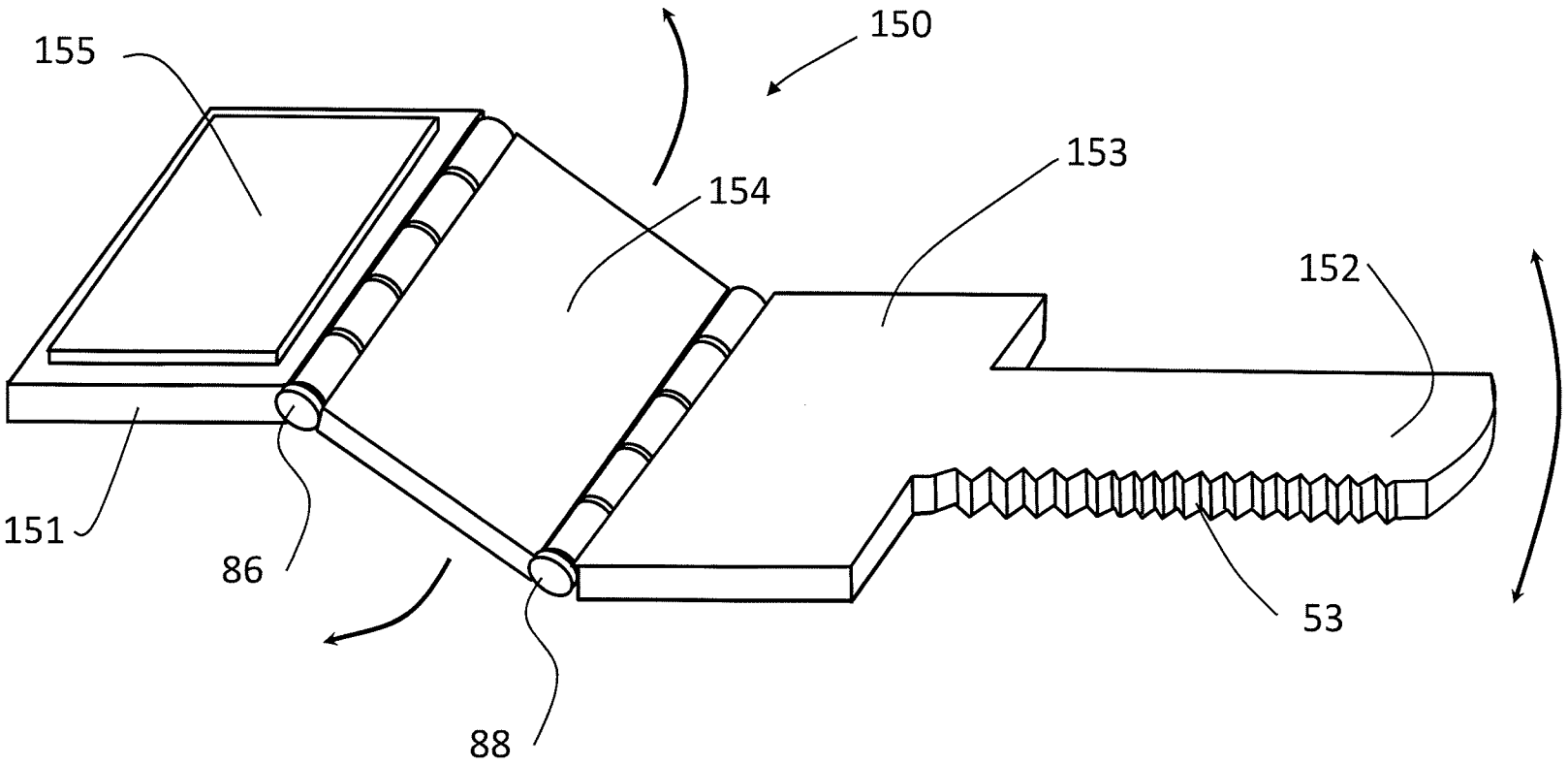
FIG. 33 shows a sixth embodiment of a drawer locking device employing two hinges.

A sixth embodiment of a drawer locking device of the present invention is shown in FIG. 33, which illustrates an extending member that includes two hinges between the attaching end portion and the locking end portion. This embodiment can be used as a closure locking means for the second style of dresser and drawer shown in FIG. 4.

The attaching end portion can comprise a first rectangular planar portion, and the locking end portion can comprise a second rectangular planar portion. A major dimension of the second rectangular planar portion can be oriented transverse to a major dimension of the first rectangular planar portion. The first rectangular planar portion can be joined along an edge by a first hinge to an edge of an intermediate planar portion, and an opposed edge of the intermediate planar portion can be joined by a second hinge to an edge of the second rectangular planar portion.

FIG. 33 shows an extending member 150 including an attaching portion 151 that includes an attachment member 155 and is linked to the locking end portion 152 by two hinges 86 and 88 which are connected by the linking portion 154. The locking end portion 152 can include a wider portion 153 extending from the hinge 88 and extending toward, and narrowing to, the locking end portion 152. The wide portion 153 extends from the hinge 88 by a dimension of the thickness of the top rail 15, typically about ¾ inch (about 1.9 cm) to about 1 inch (about 2.5 cm). The hinges 86 and 88 can be any hinging means, including, but not limited to a butt hinge, a piano hinge and a butterfly hinge, and a living (plastic) hinge. The dimensions of the attaching portion 151 are shown rectangular, with the longer side disposed lateral to the extending direction. It can be understood that the attaching portion can be made even more laterally extending (a larger lateral length) or more elongated (a larger length in the opening direction) to suit the need. The locking end portion 152 includes a locking means, illustrated as the lock engaging teeth 53.

Figure 34:
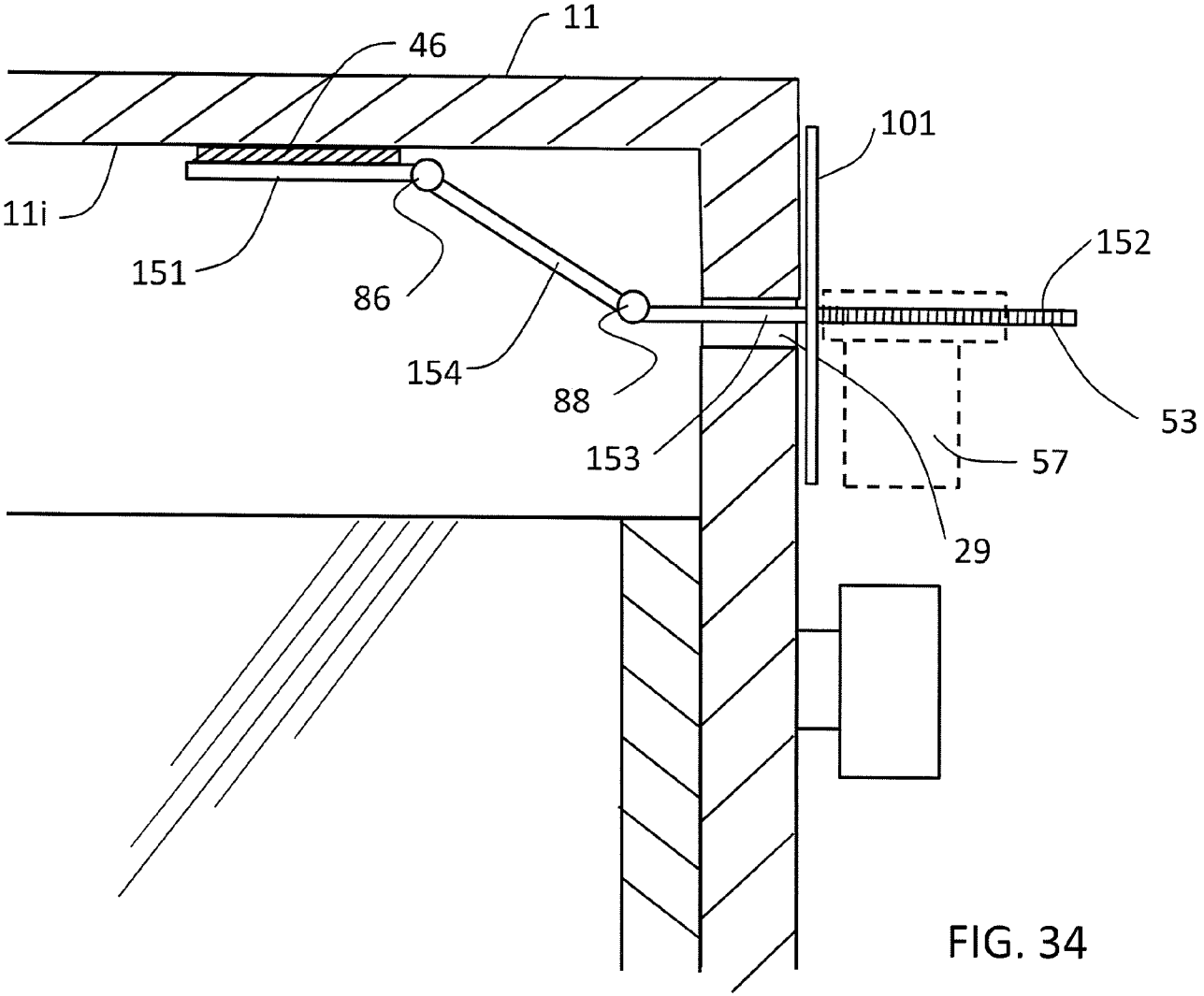
FIG. 34 shows the sixth embodiment of the drawer locking device of FIG. 33 installed and locked to the second type of dresser and drawer with the drawer closed.

The embodiment shown in FIG. 33 can be used with the second type of dresser-drawer designs of FIG. 4, as shown in FIG. 34, optionally with a shield 101.

The present invention also relates to a method of locking and securing a drawer of the furniture using the locking device. Typically the method for securing closed a drawer within a drawer opening of a furniture comprises the steps of: a) opening a drawer of a furniture; b) using the adhesive side of the base member to attach the base member to an interior surface of a frame of the furniture; c) extending a locking end portion of an extending device through a gap between the drawer and the frame and attaching an attaching end portion of the extending device to the base member; d) closing the drawer to expose the locking end portion; and e) attaching a locking means to the locking end portion to prevent the drawer from opening within the drawer opening.

Figure 35:
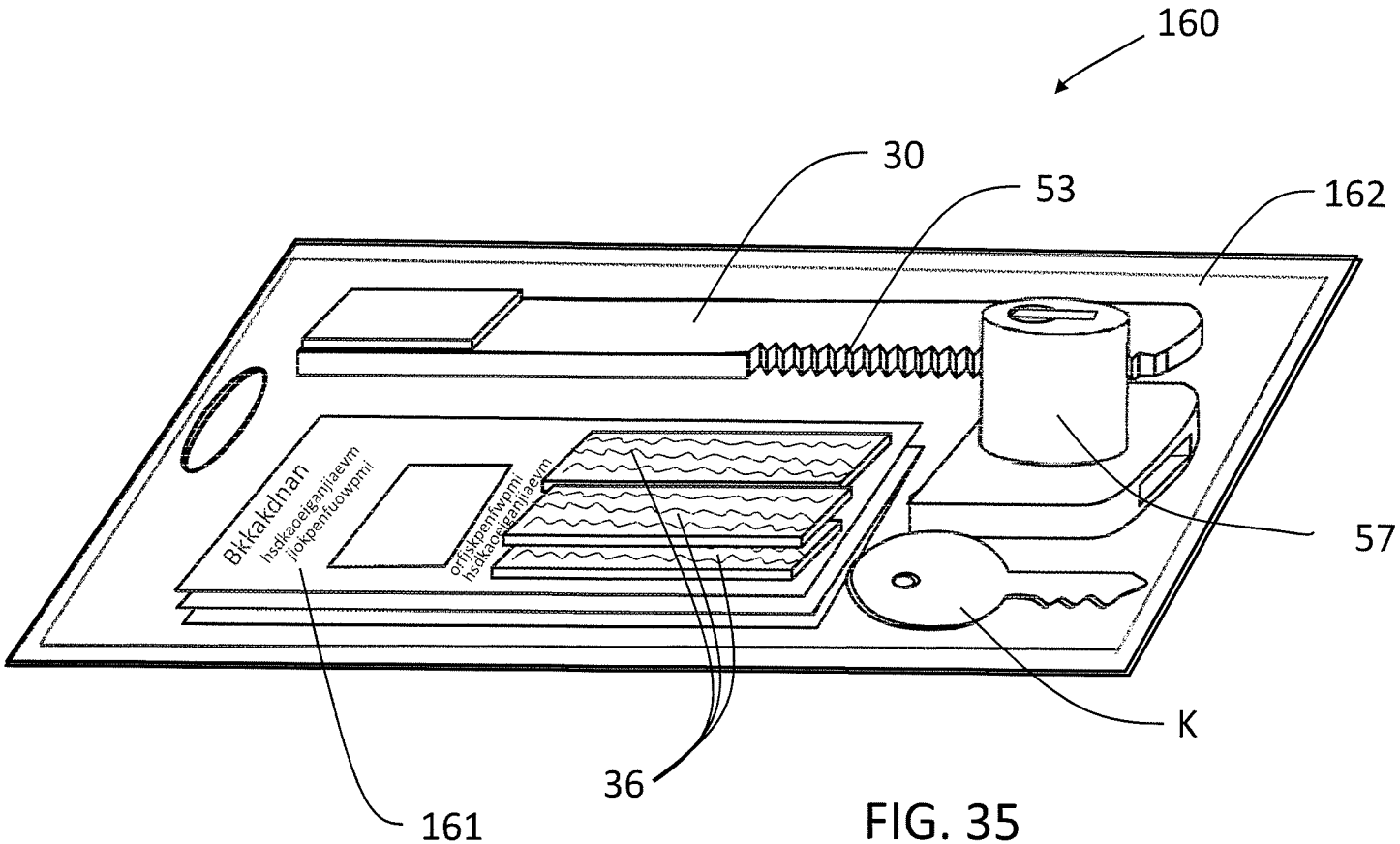
FIG. 35 shows an article of manufacture that includes a locking device consisting of an extending member with a locking means, base members, and instructions for use.

The invention also relates to an article of manufacture comprising the locking device comprising a base member and an extending member with a locking means, which can be a plurality of holes or bores 33, or a plurality of lock engaging teeth 53, and a lock device, which can be a padlock or combination lock, or a ratcheting lock 57, packaged in association with instructions for use by a consumer of the locking device with furniture, for locking and securing a drawer of the furniture using the locking device. The instructions direct the consumer to attach the locking device to the furniture having a drawer, and for closing and locking the drawer in the furniture. The article of manufacture can comprises more than one base member to allow a user to use and reuse the same extending member in more than one furniture. FIG. 35 shows an article of manufacture 160 that includes a locking device consisting of an extending member 30 with a plurality of lock engaging teeth 53, a ratcheting lock 57 with one or more keys K, three base members 36, and instructions 161 for use by a consumer, which can include text and images for facilitating the understanding of the user of the use of the locking device with furniture, for locking and securing a drawer of the furniture using the locking device. In an alternative embodiment, the article of manufacture can comprise an extending member with the locking portion comprising a plurality of holes 33, and a padlock. The article of manufacture includes a suitable packing for the other elements, illustrated as a transparent plastic film 162 that is sealed around the edges. Other suitable packaging materials can be used.

A seventh embodiment of a drawer locking device of the present invention is shown in FIGS. 36A-40, which illustrates an attaching end portion of an extending member that has at least one aperture 175 therethrough, and a fastener for pivotably securing the attaching end portion to the inside surface 11*i* of the top 11 of the furniture. The aperture is sufficient in diameter or size to allow the threads of a fastener 176, such as a screw, to pass through and into the underside of the dresser top 11, and to hold and attach the extending member to the inside surface 11*i* of the top 11 of the furniture, while allowing the attaching end portion of the extending member a free rotation, or pivoting, around the neck of the screw. The outside portion of the aperture can optionally have a counter sink to accommodate a tapered head of the fastener, such as a taper-headed screw, when used. The fastener screw can be threaded into the dresser top from inside the drawer opening, using a screw driver or other implement, or by employing a thumb screw 177 as shown in FIG. 36C. The length of the fastener should be as short as possible to obtain secure fastening into the wood surface, to minimize penetrating or bulging the outside surface of the wood structure. Insertion of the screw into a wooden surface can be aided by forming a tap hole, by boring with a gimlet or using an awl.

The seventh embodiment for pivotably fastening the attaching end portion can be used in combination with certain other embodiments of the invention, for example, with the first, fifth and sixth embodiments of the invention.

Figure 36C:
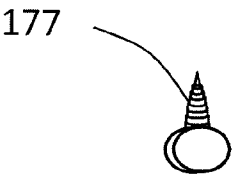
FIG. 36C shows a thumb screw that can be used as a fastener of the drawer locking device to the furniture.
Figure 36A:
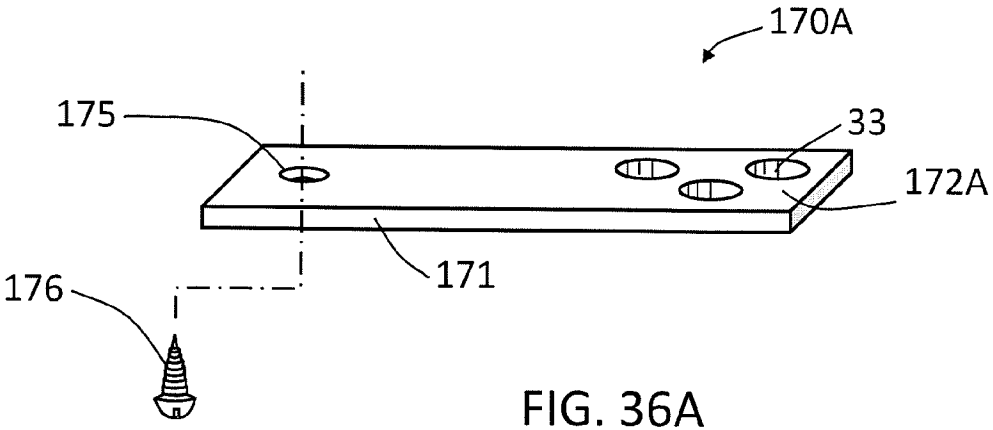
FIG. 36A shows a seventh embodiment of a drawer locking device having an attaching end portion that has an aperture therethrough, and a fastener for pivotably securing the attaching end portion to the inside surface of the furniture, used with the extending member of the first embodiment of a drawer locking device of FIG. 7.

FIG. 36A shows a drawer locking device 170A of the seventh embodiment in combination with the first embodiment of a drawer locking device illustrated in FIG. 7. The attaching end portion 171 includes an aperture 175 (rather than using the base member of the first embodiment) that is pivotably fixed to the inside of a dresser piece of furniture, and a locking end portion 172A that extends exteriorly from within the dresser through the drawer gap 29, and is otherwise substantially as described as for the first embodiment. This embodiment can be used as a drawer locking device for the first style of dresser and drawer shown in FIG. 3, in combination with a fastener 176, with the locking end portion 172A extending between the drawer 20 and top 11 of the dresser frame.

Figure 36B:
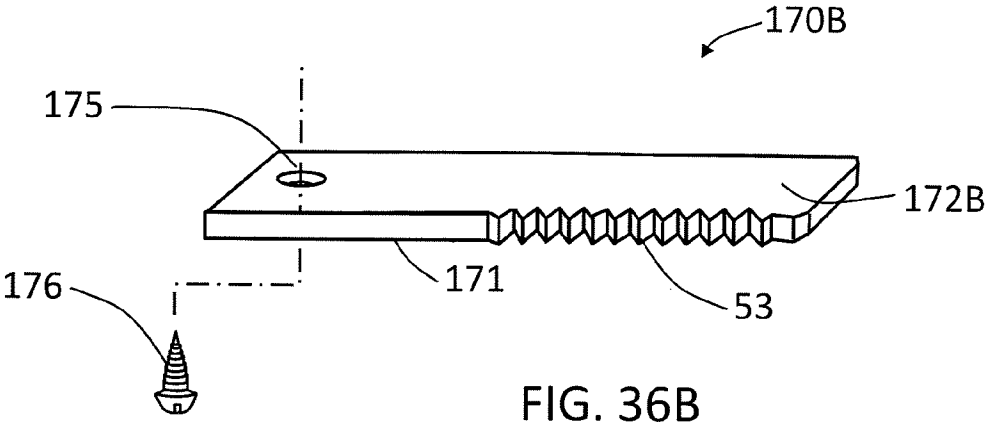
FIG. 36B shows alternative of the seventh embodiment of FIG. 36A with an extending member configured for the ratcheting lock.

FIG. 36B shows an alternative of the seventh embodiment of FIG. 36A with an extending member configured for the ratcheting lock, in combination with a fastener 176.

Figure 37:
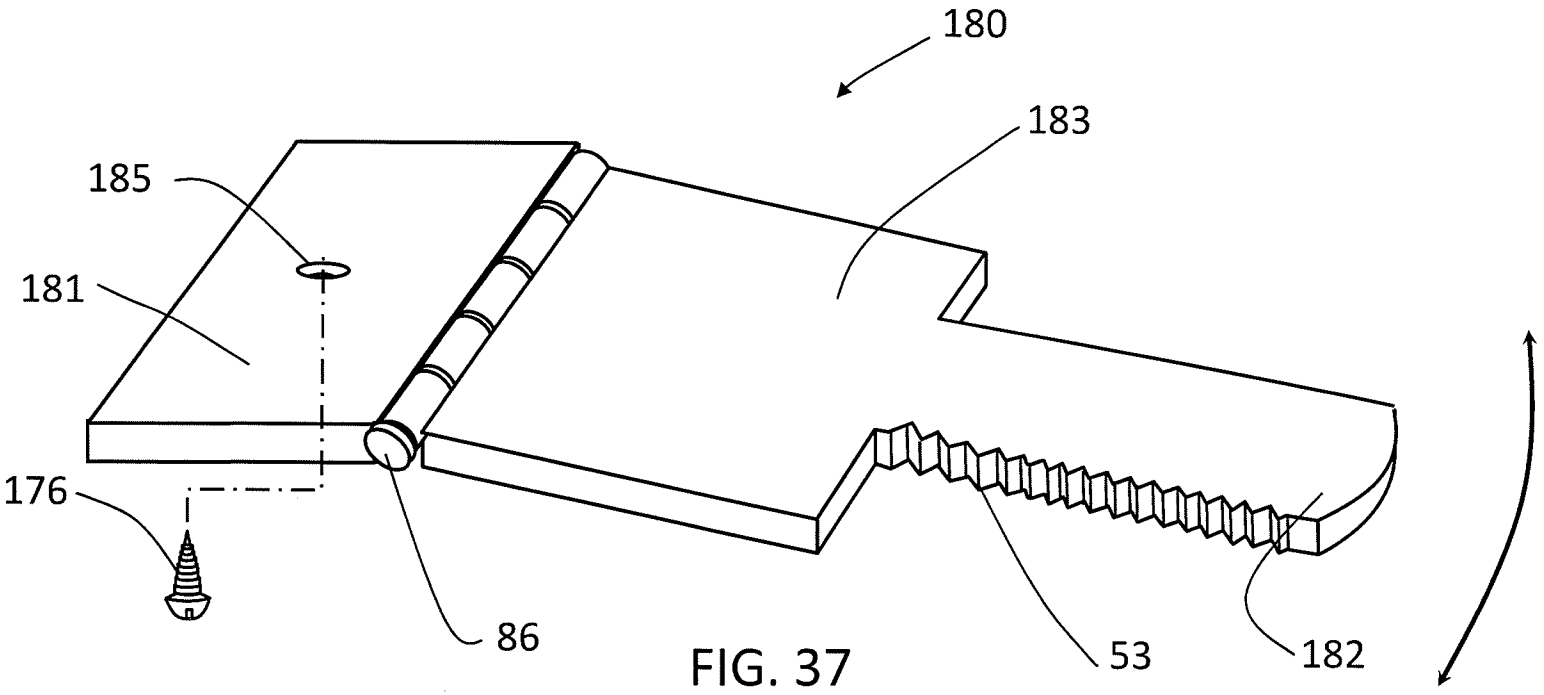
FIG. 37 shows another alternative of the seventh embodiment having an aperture through the attaching end portion, used with the extending member of the fifth embodiment of a drawer locking device of FIG. 29 that has a hinge, configured for the ratcheting lock.

FIG. 37 shows another embodiment of the seventh embodiment as drawer locking device 180, in combination with the fifth embodiment of a drawer locking device illustrated in FIG. 29. The attaching end portion 181 includes an aperture 185 (rather than using the base member of the fifth embodiment) that is pivotably fixed to the inside surface 11*i* of the top 11 of a dresser piece of furniture, using a fastener 176, and a locking end portion 182 that extends exteriorly from within the dresser through the drawer gap 29, and is otherwise substantially as described as for the fifth embodiment. This embodiment can be used as a drawer locking device for the third style of dresser and drawer shown in FIG. 5, with the locking end portion 182 extending between the drawer 20 and top 11 of the dresser frame.

Figure 38:
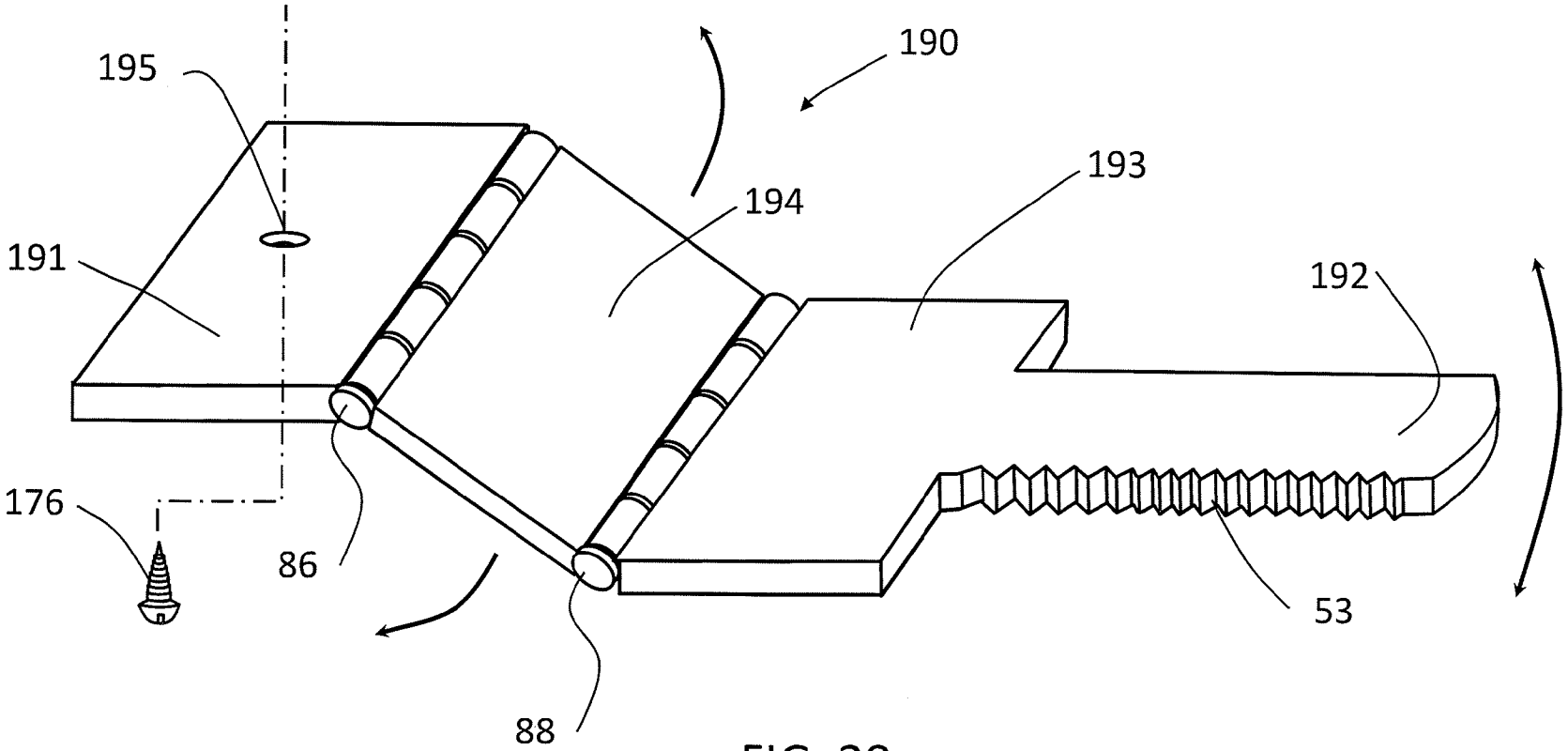
FIG. 38 shows another alternative of the seventh embodiment having an aperture through the attaching end portion, used with the extending member of the sixth embodiment of a drawer locking device of FIG. 33 that has a pair of hinges, configured for the ratcheting lock.

FIG. 38 shows another embodiment of the seventh embodiment as drawer locking device 190, in combination with the sixth embodiment of a drawer locking device illustrated in FIG. 33. The attaching end portion 191 includes an aperture 195 (rather than using the base member of the sixth embodiment) that is pivotably fixed to the inside surface 11*i* of the top 11 of a dresser piece of furniture, using a fastener 176, and a locking end portion 192 that extends exteriorly from within the dresser through the drawer gap 29, and is otherwise substantially as described as for the sixth embodiment. This embodiment can be used as a drawer locking device for the second style of dresser and drawer shown in FIG. 4, with the locking end portion 192 extending between the drawer 20 and top 11 of the dresser frame.

Figure 39:
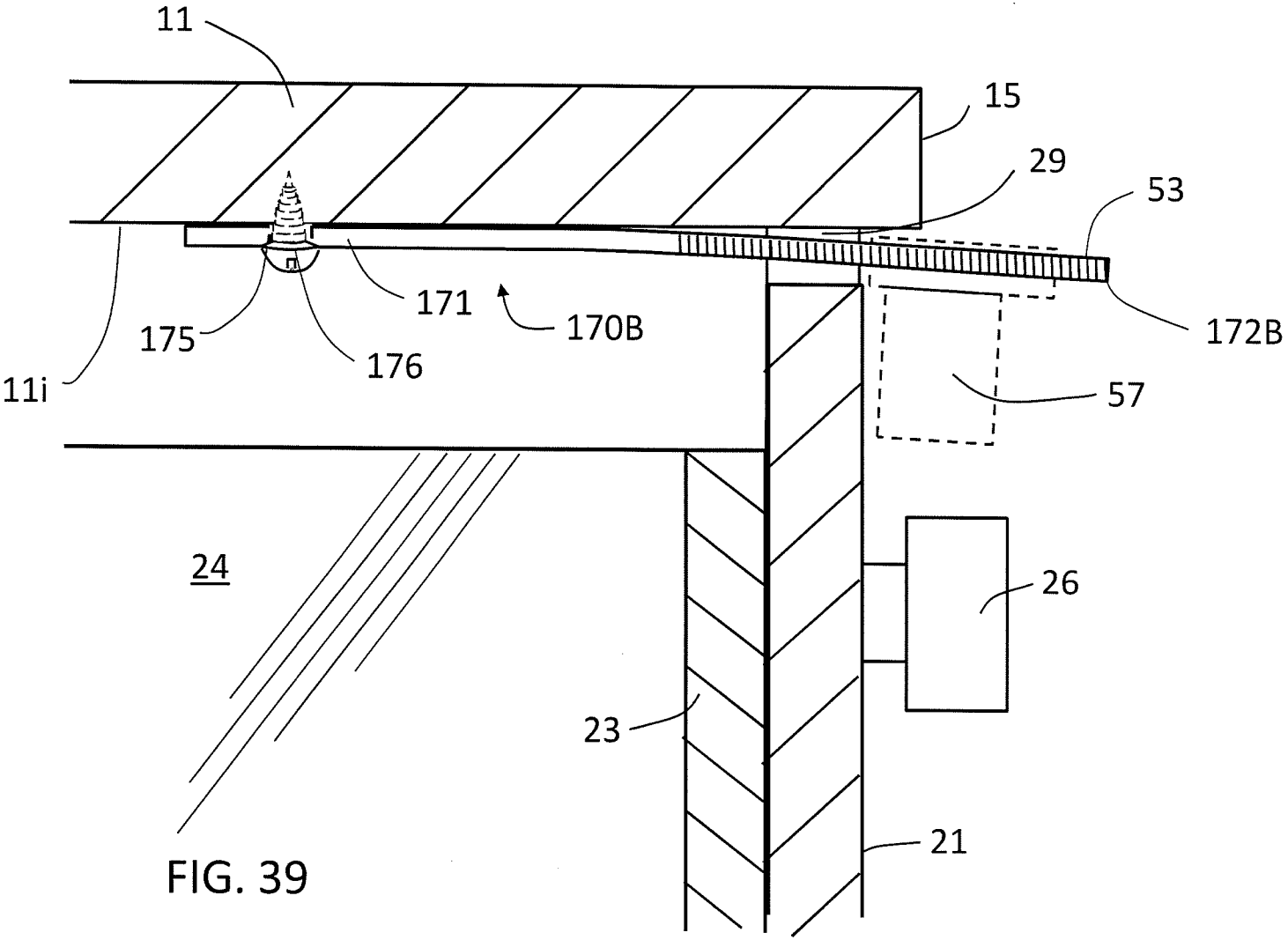
FIG. 39 shows the seventh embodiment of the drawer locking device of FIG. 36B installed and locked to the first type of dresser and drawer with the drawer closed.

In a typical installation of a drawer locking device of the seventh embodiment, a gimlet is employed to bore a tap hole, and a round-headed wood screw 176 is inserted through the aperture 175 and, with the attaching end portion held against the inner surface 11*i*, threaded into the dresser top 11. The screw is tightened well enough to firmly hold the extending member, while still leaving a tiny gap between the screw head and the aperture to allow the attaching end portion of the extending member a free rotation, or pivoting, around the neck of the screw. After the drawer is closed with the extending member protruding through the gap 29, the ratcheting lock is inserted over the end of the extending member and pressed ratchetedly tight against the drawer face 21 as shown in FIG. 39.

Figure 40:
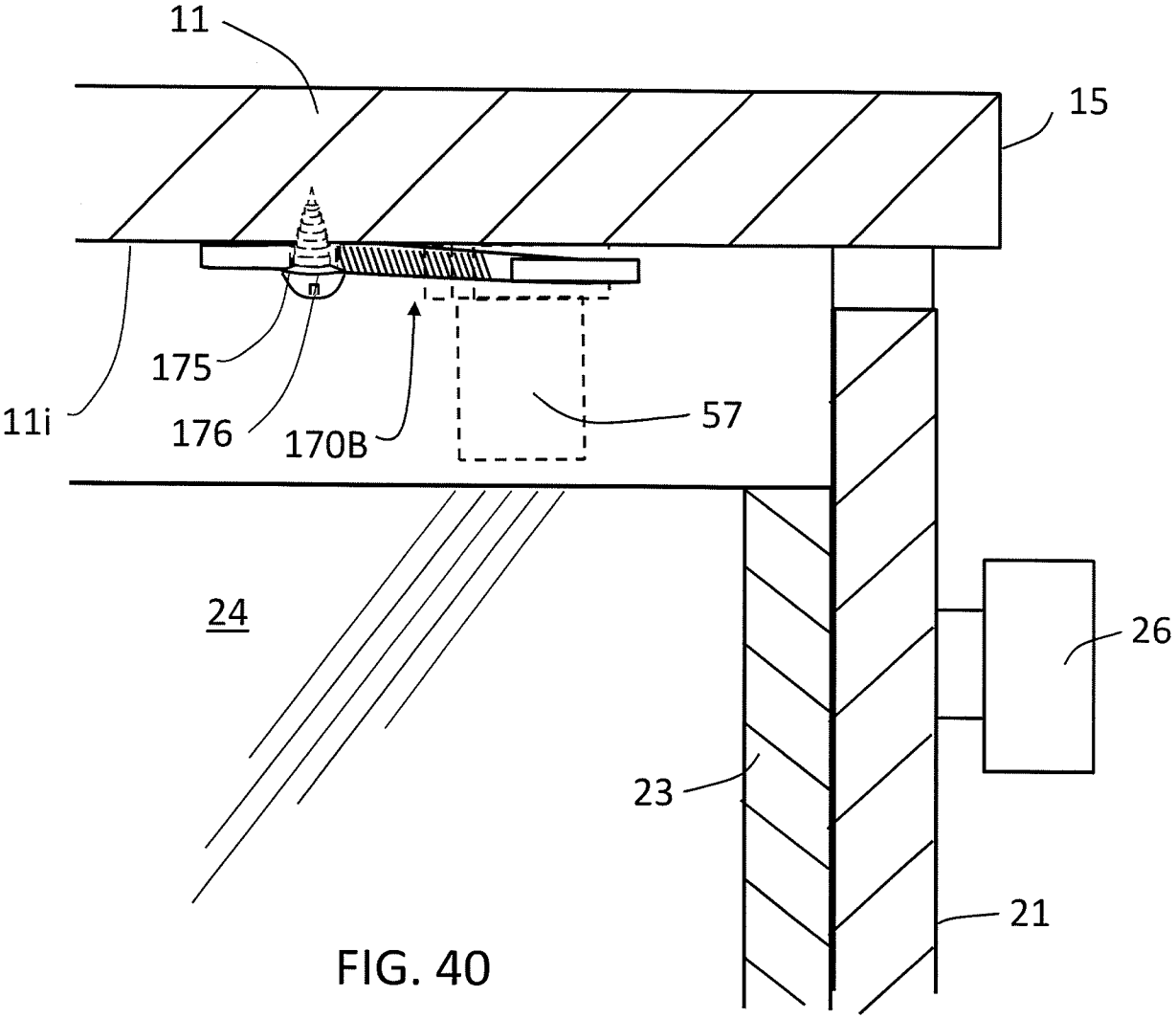
FIG. 40 shows the embodiment of the installed drawer locking device of FIG. 39, pivoted to a storage position.
Figure 41:
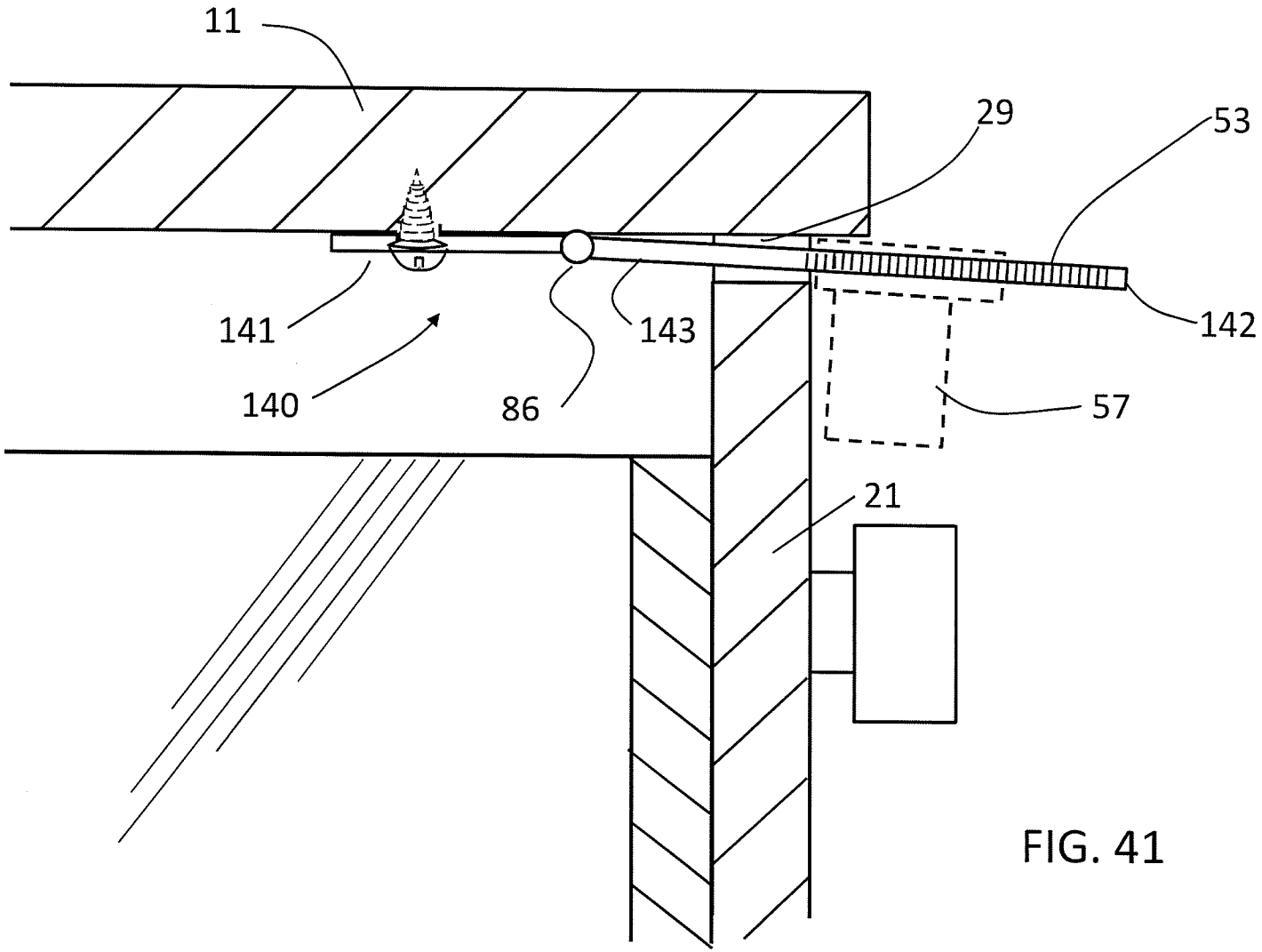
FIG. 41 shows the seventh embodiment of the drawer locking device of FIG. 37 installed and locked to the first type of dresser and drawer with the drawer closed.
Figure 42:
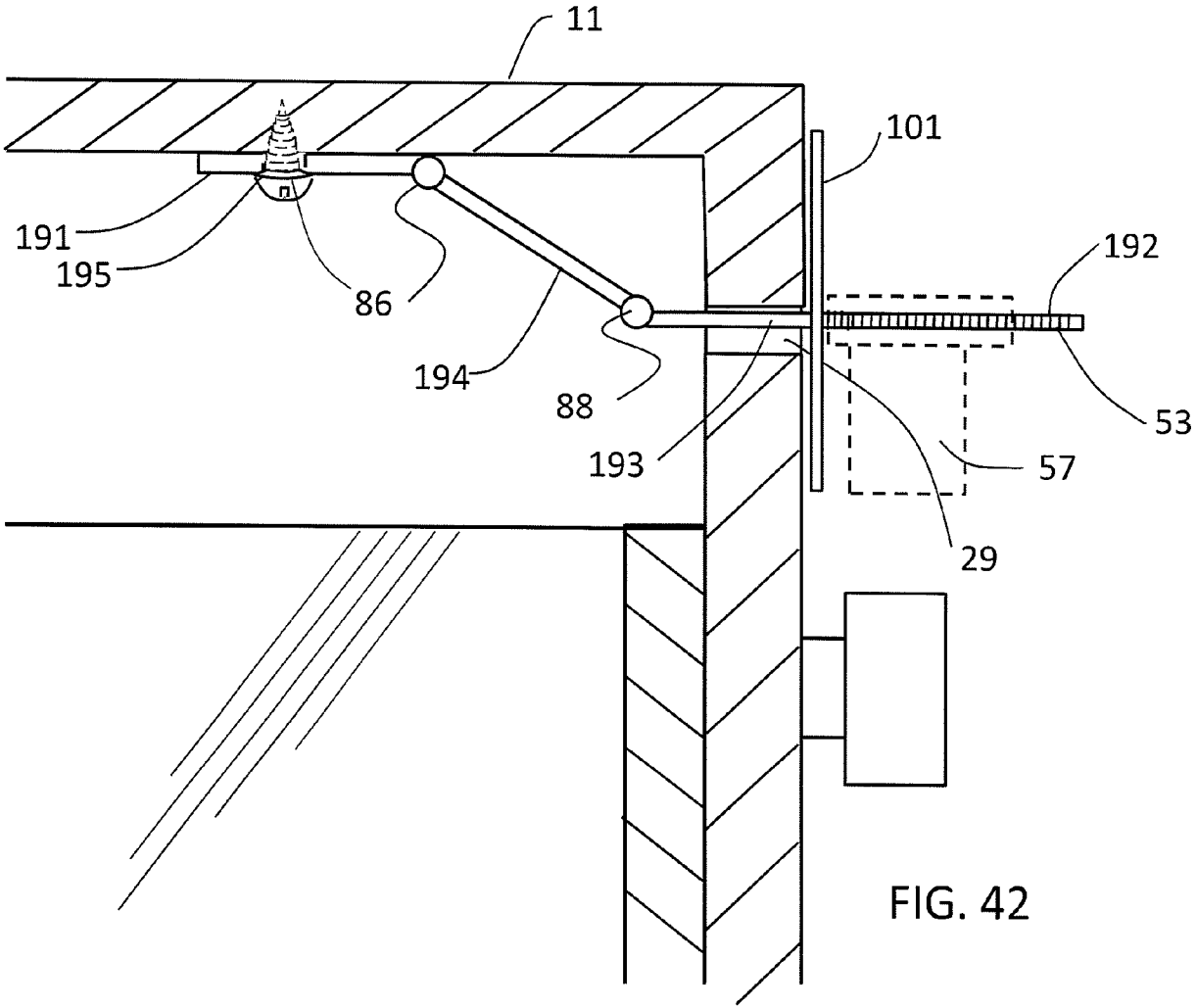
FIG. 42 shows the seventh embodiment of the drawer locking device of FIG. 38 installed and locked to the second type of dresser and drawer with the drawer closed.

After opening the drawer by unlocking and removing the ratcheting lock from the end of the extending member, the drawer locking device can be pivoted through the opening and within the drawer space of the dresser to a storage position as shown in FIG. 40, typically nearly perpendicular to the protruding position. The unsecured drawer can then be used and opened and closed, with the drawer locking device being hidden in the storage position The drawer locking device embodiments of the drawer locking device of FIGS. 37 and 38 can be installed into a dresser and drawer of the third style and second style, respectively, in substantially the same manner, and used to secure closed the drawer with a ratcheting lock, as shown in FIGS. 41 and 42.

The embodiments of the drawer locking device of FIGS. 37 and 38 can be pivoted to a storage position in the same manner as shown in FIG. 40.

Figure 43:
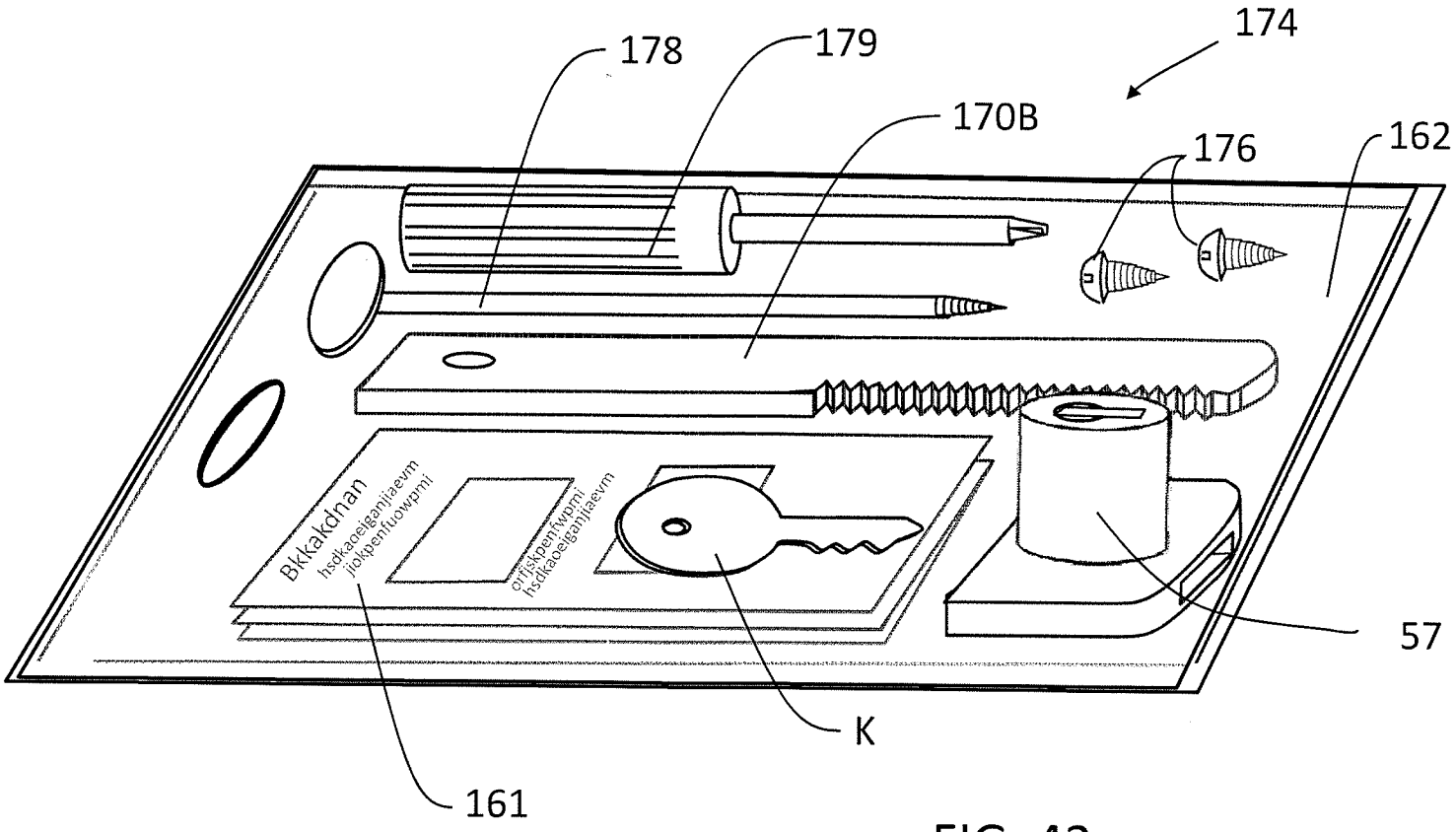
FIG. 43 shows an article of manufacture that includes a locking device of FIG. 36B, ratcheting lock, key(s), securement screws, screwdriver and boring tool, and instructions for use.

The invention also relates to an article of manufacture 174 comprising the seventh embodiment of the drawer locking device. In FIG. 43 is shown the drawer locking device 170B with a ratcheting lock 57 with one or more keys K, packaged in association with instructions 161 for use by a consumer of the locking device with furniture, for locking and securing a drawer of the furniture using the locking device. The instructions direct the consumer to attach the locking device to the furniture having a drawer, and for closing and locking the drawer in the furniture, and pivoting the locking device to a storage position. The article of manufacture can comprise one or more fasteners, such as a wood screw 176, and can include a gimlet 178 for boring a tap hole, and a screw driver 179 for driving the wood screw. The article of manufacture includes a suitable packing for the other elements, illustrated as a transparent plastic film 162 that is sealed around the edges. Other suitable packaging materials can be used.

It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

We claim:

1. A device in combination with a furniture having a drawer, for securing closed the drawer of the furniture, including:

a) a furniture including a frame and a drawer, the frame including a top member having a lower interior surface and a front edge that defines the upper end of a drawer opening, and the drawer including a front face wall having a top edge, wherein the top edge of the front face wall extends over the front edge of the top member when the drawer is in a closed position, to define a gap between the front edge of the top member and an inner surface of the top edge of the front face wall;

b) a securable base member having an adhesive side for securement to the lower interior surface of the top member of the furniture and an opposed mechanical fastener side, the securable base member when secured being inaccessible from outside the furniture when the drawer is closed within the drawer opening of the frame, and providing a base member having an adhesive side and an opposed mechanical fastener side;

c) an extending member having an attaching end portion that includes a second mechanical fastener on an upper surface that attaches releasably to the mechanical fastener side of the securable base member, and a locking end portion, where a distal portion of the locking end portion is configured to extend exteriorly through the drawer opening and through the gap between the top edge of the front face wall of the drawer and the front edge of the top member of the frame, wherein the attaching end portion comprises a first planar portion and the locking end portion comprises a second planar portion that extends in a plane different and parallel to a plane through the first planar portion, and an intermediate planar portion connects a forward edge of the first planar portion with a rearward edge of the second planar portion, and the locking end portion includes a locking means for preventing the drawer, when closed, from opening within the drawer opening.

2. The combination according to claim 1, wherein the base member has an inner surface that releasably secures to the interior surface of the frame, and an outer surface that releasably secures to an inner surface of the attaching end portion of the extending member.

3. The combination according to claim 2, wherein the base member has an inner surface that includes an adhesive layer that adheres to the interior surface of the frame, and an outer surface includes a first mechanical fastener material, and the inner surface of the attaching end portion of the extending member includes a second mechanical fastener material that mechanically attaches to the first mechanical fastener material.

4. The combination according to claim 1, wherein the locking means includes at least one hole through the locking end portion, through which a shackle of a separate padlock can be inserted.

5. The combination according to claim 4, wherein the locking means includes a plurality of holes arranged in a crisscrossing pattern.

6. The combination according to claim 1, wherein the locking means includes a plurality of lock engaging elements along at least one edge of the locking end portion, and a lock member having a transverse slot through which the locking end portion extends, the lock member securing to one or more of the plurality of lock engaging elements.

7. The combination according to claim 1, further including a shield positionable inboard of the locking means along the locking end portion, the shield having one or more slot openings through which the locking end portion can extend.

8. The combination according to claim 7, wherein the shield is a plate.

9. The combination according to claim 8 wherein the shield has an angled shape.

10. The combination according to claim 1, wherein a major dimension of the second planar portion is oriented transverse to a major dimension of the first planar portion.

11. The combination according to claim 10, wherein the intermediate planar portion and the second planar portion extend from the middle of a forward edge of the first planar portion, and the lateral ends of the first planar portion extend outward laterally from the side edges of the second planar portion that connect to the intermediate planar portion.

12. The combination according to claim 11, wherein the first planar portion is a first rectangular planar portion, the second planar portion is a second rectangular planar portion, and the first rectangular planar portion, the second rectangular planar portion, and the intermediate planar portion comprise a unitary plate.

13. The combination according to claim 12, further comprising a spring wall extending from a rearward edge opposite the forward edge of the first rectangular planar portion.

14. The combination according to claim 1, wherein the first planar portion is joined along an edge by a first hinge to an edge of an intermediate planar portion, and an opposed edge of the intermediate planar portion is joined by a second hinge to an edge of the second planar portion.

15. A method for securing closed a drawer within a drawer opening of a furniture, the furniture including a frame and the drawer, the frame including a top member having a lower interior surface and a front edge that defines the upper end of a drawer opening, and the drawer including a front face wall having a top edge, wherein the top edge of the front face wall extends over the front edge of the top member when the drawer is in a closed position, to define a gap between the front edge of the top member and an inner surface of the top edge of the front face wall, the method comprising the steps of:

a) opening the drawer of the furniture within the drawer opening of the frame;

b) providing a base member having an adhesive side and an opposed mechanical fastener side, and attaching the adhesive side to the lower interior surface of the top member of the furniture;

c) providing an extending member having an attaching end portion that includes a second mechanical fastener on an upper surface and a locking end portion, wherein the attaching end portion comprises a first planar portion and the locking end portion comprises a second planar portion that extends in a plane different and parallel to a plane through the first planar portion, and an intermediate planar portion extends up from and connects a forward edge of the first planar portion with a rearward edge of the second planar portion;

d) extending a distal portion of the locking end portion out through the drawer opening and attaching the second mechanical fastener to the mechanical fastener side of the base member, with the attaching end portion positioned adjacent the lower interior surface of the top member, and the intermediate planar portion positioned adjacent the front edge of the top member;

e) closing the drawer within the drawer opening to position the intermediate planar portion of the extending member within the gap, to expose the locking end portion outside the furniture;

f) providing a shield plate having at least one slot opening, and placing the shield plate with the locking end portion extending through the at least one slot opening;

g) attaching a locking means to the locking end portion and against the shield plate, to prevent the drawer from opening within the drawer opening.

16. The method according to claim 15 wherein the locking end portion includes a plurality of lock engaging teeth along at least one side edge, and the locking means is a ratcheting lock.

17. An article of manufacture comprising:

a) instructions for use by a consumer for locking and securing a drawer of a furniture, the furniture including a frame and a drawer, the frame including a top member having a lower interior surface and a front edge that defines the upper end of a drawer opening, and the drawer including a front face wall having a top edge, wherein the top edge of the front face wall extends over the front edge of the to member when the drawer is in a closed position, to define a gap between the front edge of the top member and an inner surface of the top edge of the front face wall;

b) a securable base member having an adhesive side for securement to the lower interior surface of the top member of the furniture and an opposed mechanical fastener side, the securable base member when secured being inaccessible from outside the furniture when the drawer is closed within the drawer opening of the frame, and providing a base member having an adhesive side and an opposed mechanical fastener side;

c) an extending member having an attaching end portion that includes a second mechanical fastener on an upper surface that attaches releasably to the mechanical fastener side of the securable base member, and a locking end portion, where a distal portion of the locking end portion is configured to extend exteriorly through the drawer opening and through the gap between the top edge of the front face wall of the drawer and the front edge of the top member of the frame, wherein the attaching end portion comprises a first planar portion and the locking end portion comprises a second planar portion that extends in a plane different and parallel to a plane through the first planar portion, and an intermediate planar portion connects a forward edge of the first planar portion with a rearward edge of the second planar portion, and the locking end portion includes a locking means for preventing the drawer, when closed, from opening within the drawer opening;

d) a lock device; and e) packaging for the extending member, the securable base member, the lock device, and the instructions.

18. The article of manufacture according to claim 17, wherein the instructions include a description that directs the consumer for attaching the securable base member to a lower surface of a top member of the furniture, for attaching the attaching end of the extending member to the secured base member, and for attaching the locking means to the locking end portion of the extending member, for closing and locking the drawer in the furniture.

19. The article of manufacture according to claim 17 including more than one securable base member, and the instructions describe using the more than one securable base member with the same extending member in more than one furniture.

* * * * *